US008251025B2

(12) United States Patent
Riley

(10) Patent No.: US 8,251,025 B2
(45) Date of Patent: Aug. 28, 2012

(54) TWO-STROKE ENGINE

(75) Inventor: T. Matthew Riley, Park City, KS (US)

(73) Assignee: Grail Engine Technologies, Inc., Chapman, KS (US)

( * ) Notice: Subject to any disclaimer, the term of this patent is extended or adjusted under 35 U.S.C. 154(b) by 222 days.

(21) Appl. No.: 12/805,011

(22) Filed: Jul. 7, 2010

(65) Prior Publication Data

US 2011/0036313 A1 Feb. 17, 2011

Related U.S. Application Data

(60) Provisional application No. 61/272,098, filed on Aug. 17, 2009.

(51) Int. Cl.
*F02B 25/04* (2006.01)

(52) U.S. Cl. ..... 123/65 VC; 123/65 B; 123/65 V; 123/73 AV

(58) Field of Classification Search ..... 123/65 R, 123/65 B, 65 V, 65 VC, 73 R, 73 AA, 73 AV, 123/73 AE, 73 C, 74 AE, 74 B, 74 D, 70 R
See application file for complete search history.

(56) References Cited

U.S. PATENT DOCUMENTS

| | | | | |
|---|---|---|---|---|
| 1,367,037 | A * | 2/1921 | Gall | 123/71 R |
| 1,532,915 | A | 4/1925 | Margetson et al. | |
| 1,744,157 | A | 1/1930 | Browne | |
| 3,059,625 | A | 10/1962 | Torre | |
| 4,000,723 | A | 1/1977 | Boyesen | |
| RE30,425 | E | 11/1980 | Boyesen | |
| 4,235,206 | A | 11/1980 | Boyesen | |
| 4,860,699 | A | 8/1989 | Rocklein | |
| 5,016,598 | A | 5/1991 | Kushibe et al. | |
| 5,490,482 | A | 2/1996 | Genet | |
| 5,603,291 | A | 2/1997 | Al-Kaheli | |
| 5,870,982 | A | 2/1999 | Strawz | |
| 6,273,037 | B1 | 8/2001 | Cobb, Jr. | |
| 6,536,384 | B1 | 3/2003 | Keoppel | |
| 6,668,788 | B2 | 12/2003 | Agama et al. | |
| 7,387,103 | B2 | 6/2008 | Merritt | |
| 2002/0159902 | A1 | 10/2002 | Beaudoin | |
| 2004/0187813 | A1 | 9/2004 | Meyer | |
| 2009/0064975 | A1 | 3/2009 | Hedman | |

FOREIGN PATENT DOCUMENTS

| | | |
|---|---|---|
| WO | WO 2008/066448 | 6/2008 |

* cited by examiner

*Primary Examiner* — Noah Kamen
(74) *Attorney, Agent, or Firm* — Richard C. Litman

(57) ABSTRACT

The two-stroke engine has a plurality of intake passages extending from the external air inlet port through the crankcase, separating the intake air charge from the air and oil vapor within the crankcase. The piston has one or more corresponding inlet tubes depending therefrom that telescope within the crankcase intake passages as the piston reciprocates. All intake air travels through these passages and is separated from the remainder of the crankcase volume. The incoming air charge passes through a concentric poppet valve in the piston crown to enter the combustion chamber. Fuel is provided by conventional direct or port injection and ignition is provided by one or more conventional spark plugs. Diesel operation is achievable when the engine is configured appropriately. Exhaust exits the combustion chamber through a poppet valve in the cylinder head, the poppet valve being actuated by a rocker arm and pushrod from a crankshaft driven cam.

18 Claims, 20 Drawing Sheets

TWO-STROKE ENGINE

CROSS-REFERENCE TO RELATED APPLICATION

This application claims the benefit of U.S. Provisional Patent Application Ser. No. 61/272,098, filed Aug. 17, 2009.

BACKGROUND OF THE INVENTION

1. Field of the Invention

The present invention relates generally to internal combustion engines, and particularly to a two-stroke reciprocating internal combustion engine having an internal structure that precludes oil mixing with the intake air charge.

2. Description of the Related Art

The reciprocating internal combustion engine has been the mainstay of motive power plants for a considerable period of time, due to its relative size and weight for its power output, fuel economy, and ease of operation. Nevertheless, such engines have their drawbacks. For example, the two-stroke engine in which both the exhaust and compression portions of the cycle occur during the upstroke of the piston and the power and intake strokes occur during the downstroke of the piston, is well known to produce relatively high power output for its size and weight due to the efficiency of a power stroke at every revolution of the crankshaft. However, such engines have historically been relatively inefficient insofar as fuel consumption and emissions production are concerned due to the lack of separation of the four distinct phases of the cycle with each having its own stroke, as in the conventional four-stroke (Otto cycle) engine.

Another problem with the two-stroke engine is that conventionally such engines initially draw the intake charge into the crankcase, whereupon the downstroke of the piston on the power stroke pressurizes the crankcase to force the intake charge into the cylinder for the next power stroke. As the crankcase is essentially continually filled with air, the conventional oil-filled crankcase used in the lubrication of the four-stroke engine cannot be used for lubrication of the two-stroke engine. Accordingly, oil is either mixed with the fuel during refueling, or oil is injected into the engine during operation, with two-stroke engines. Either system results in oil contamination of the air-fuel mixture as it passes through the engine, is burned to produce power, and passes out of the engine as exhaust. The present day requirement to reduce engine emissions precludes the use of such an engine operating principle in most applications, even though the relatively high power output of such engines for their weight can result in a desirable reduction of the weight of the vehicle in which it is installed.

Thus, a two-stroke engine solving the aforementioned problems is desired.

SUMMARY OF THE INVENTION

The two-stroke engine includes a system for separating the intake charge from the crankcase volume, thereby precluding contamination of the intake charge with lubricating oil. A pre-compression chamber or intake column is provided external to the crankcase and cylinder. A reed valve is located at the inlet to the intake column for controlling the airflow into the column. One or more additional intake passages extend along the intake column and communicate with corresponding crankcase transfer passages within the crankcase of the engine. The crankcase transfer passages communicate with piston transfer passages that depend from the piston of the engine and telescope within the crankcase transfer passages. Thus, all intake gases are completely separated from the crankcase volume and its oil vapors at all times.

A concentric poppet valve is located in the piston crown. The intake air charge flows from the intake passages through the crankcase and piston transfer passages and into the combustion chamber when the intake valve in the piston crown opens. Conventional direct fuel injection is used to deliver fuel directly into the combustion chamber, since fuel and oil are not added to the intake charge prior to delivery to the engine. Alternatively, port fuel injection may be provided to deliver fuel to the intake port(s) of the engine. One or more conventional spark plugs are used to ignite the fuel and air mixture to produce power. The engine may be operated as a diesel once initial ignition has occurred if the engine has been designed and configured for compression ignition operation.

A poppet exhaust valve is provided in the cylinder head to exhaust the spent mixture after the power stroke. The exhaust valve is actuated by a rocker arm and pushrod. The pushrod is actuated by a cam driven by rotation of the crankshaft, as is conventional in the art. Alternative exhaust valve actuation may be provided by an overhead cam driven by a mechanism from the crankshaft, if desired.

The engine disclosed in the majority of the drawings is a single cylinder, air-cooled engine. However, it will be seen that the operating principle disclosed herein may be extended to a multi-cylinder, liquid cooled engines, which is within the scope of the invention as claimed.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
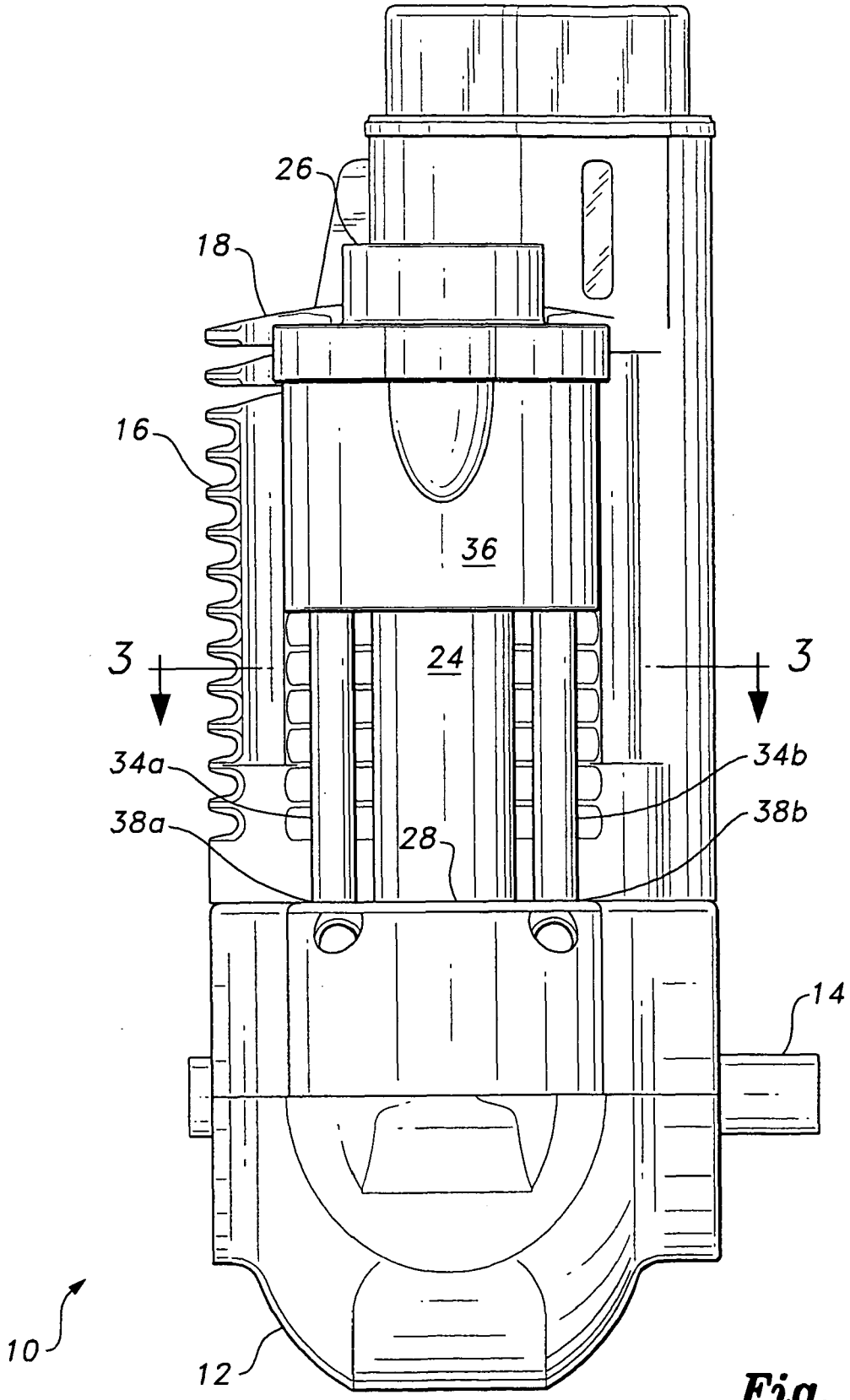
FIG. 1 is a left side elevation view of a two-stroke engine according to the present invention, illustrating its general configuration.

The two-stroke engine has an internal structure separating the intake air charge from the air and oil vapor within the crankcase, thus providing a cleaner running engine in comparison to conventional two-stroke engines. FIG. 1 provides an external left side elevation view of an exemplary air cooled, single cylinder embodiment 10 of the engine, with FIGS. 2 through 11 providing additional external and internal views of the engine 10.

Figure 2:
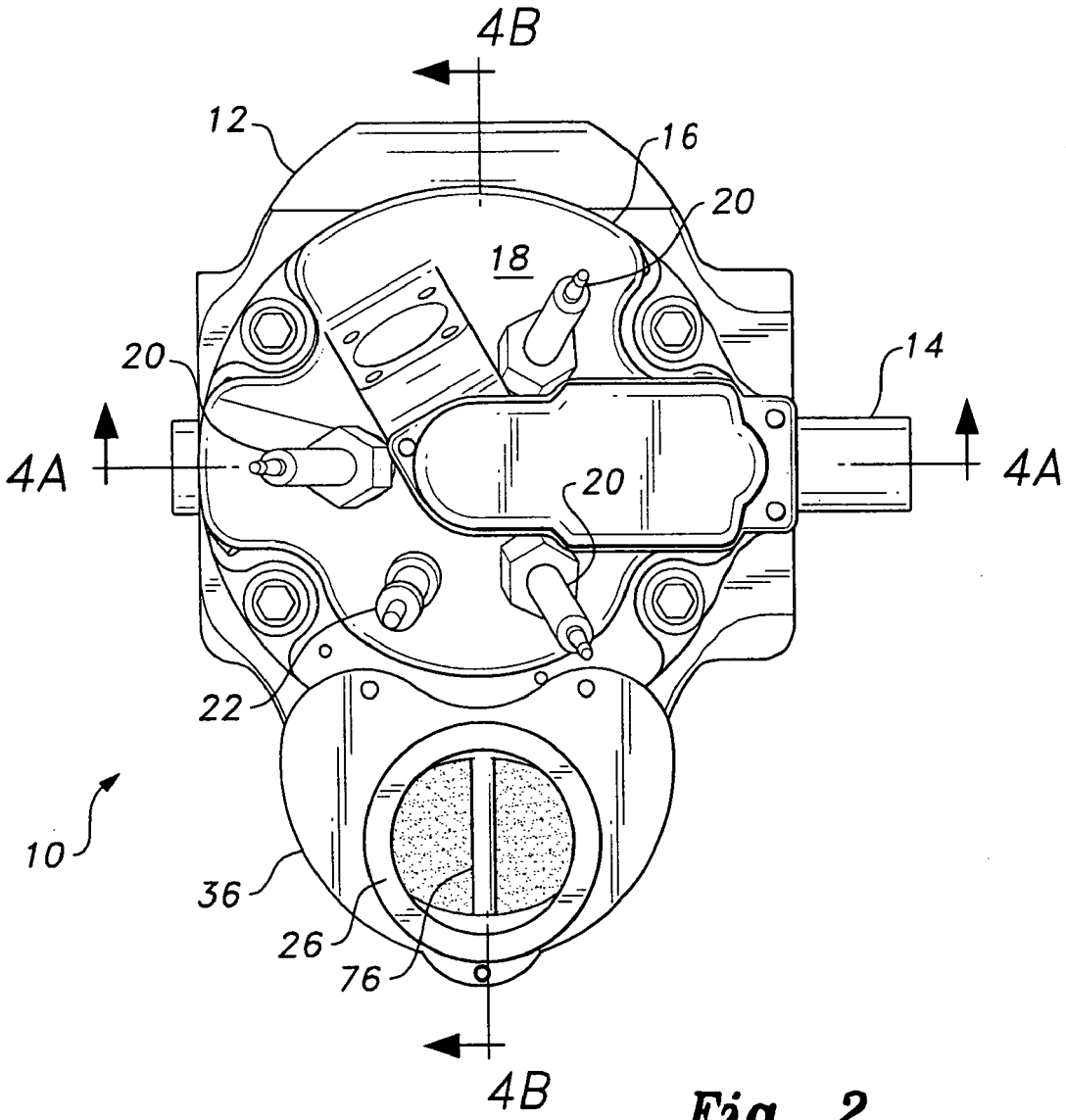
FIG. 2 is a top plan view of the engine of FIG. 1, illustrating an exemplary spark plug and fuel injection configuration.
Figure 3:
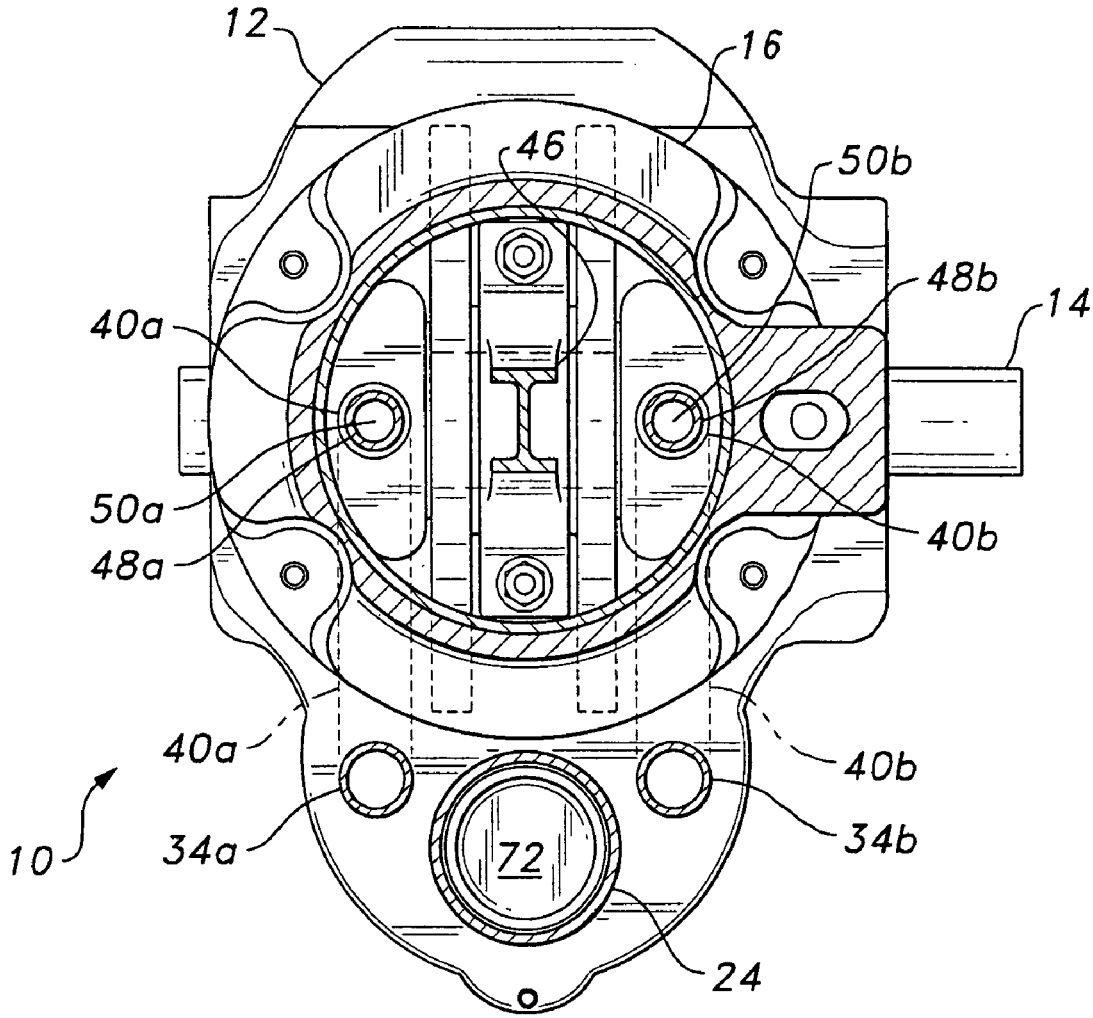
FIG. 3 is a section view along lines 3-3 of FIG. 1.

The engine 10 includes a crankcase 12 having a crankshaft 14 disposed therein. A cylinder 16 extends from the crankcase 12. The cylinder 16 includes a cylinder head 18 thereon. The head 18 has provision for at least one spark plug 20 and fuel injector 22 (direct or port) therein. The head 18 may include multiple spark plugs 20, as shown in FIG. 2 of the drawings.

An intake column 24 extends externally along the left side of the cylinder 16. The intake column 24 has an inlet end 26 adjacent the cylinder head 16 and an opposite base 28 joined with the crankcase 12 and communicating with the crankcase chamber or internal fluid volume 30 thereof (as shown in FIGS. 4A through 11B), the column 24 defining an intake volume 32 therein. At least one, and preferably two, external intake passages (tubes, etc.) 34*a* and 34*b* extend along the cylinder 16 and adjacent to the intake column 24. These two external passages 34*a*, 34*b* have inlet ends communicating with the inlet end 26 of the intake column 24 via an intake plenum or air box 36. The opposite bases 38*a*, 38*b* of the external passages 34*a*, 34*b* extend into the crankcase 12 and communicate with internal crankcase intake passages 40*a* and 40*b*, respectively, which serve to separate the intake volumes 42*a*, 42*b* therein from combustion gases, oil, or other fluids in the chamber or internal volume 30 of the crankcase 12. The crankcase intake passages 40*a*, 40*b* each extend upwardly from the interior of the crankcase 12 into the lower portion of the interior of the cylinder 16 and have upper portions parallel to the axis of the cylinder 16.

A piston 44 reciprocates within the cylinder 16, and is connected mechanically to the crank throw of the crankshaft via a conventional connecting rod 46. The piston 44 includes at least one piston inlet passage, and preferably a plurality of piston inlet passages 48*a* and 48*b*, depending therefrom. These piston inlet passages 48*a*, 48*b* correspond in number to the internal crankcase intake passages 40*a*, 40*b*, and telescope within their respective crankcase inlet passages 40*a*, 40*b* as the piston 44 reciprocates within the cylinder 16 during engine operation. The piston inlet passage 48*a*, 48*b* are each hollow and define intake volumes, respectively 50*a* and 50*b*, with the intake volumes 42*a*, 42*b* of the crankcase inlet passages 40*a*, 40*b* communicating with the intake volumes 50*a*, 50*b* of the piston inlet passages 48*a*, 48*b* in an essentially continuous flow during engine operation. It will thus be seen that the fixed crankcase inlet passages 40*a* and 40*b* and their mating and telescoping piston inlet passages 48*a* and 48*b* separate and seal their respective inlet volumes 42*a*, 42*b* and 50*a*, 50*b* from the internal crankcase volume 30 to preclude contamination of the inlet air charge with oil vapor from the crankcase internal volume 30 during engine operation.

FIGS. 4A through 11B provide a series of progressive views of the engine 10 during operation, with each set of Figs. A and B showing the progressive positions of the internal components of the engine 10 at each 45° of clockwise rotation of the crankshaft 14. It will be noted that the engine may be made to rotate in the opposite, counterclockwise direction by adjusting the timing of the cam 62 (discussed further below) relative to the crankshaft 14, and adjusting the ignition timing accordingly for spark ignition engines. The piston 44 includes a concentric poppet intake valve 52 in the crown 54 thereof, with the intake valve 52 reciprocating to open and close ports 56*a* and 56*b* extending through the piston 44 and communicating with the respective piston intake passages 48*a*, 48*b*. The intake valve 52 is actuated primarily by differential pressure between the inlet passage volumes 42*a*, 42*b*, 50*a*, and 50*b*, and the upper cylinder and combustion chamber 58 during engine operation, although a conventional return spring (not shown) may be installed about the intake valve stem in the piston 44 as required. No mechanical timing mechanism is provided for the intake valve 52, as operation of the valve 52 is dependent upon differential pressure between the crankcase and the upper cylinder. Thus, the intake valve 52 operates properly regardless of the direction of rotation of the engine.

A poppet exhaust valve 60 is installed concentrically through the cylinder head 18. The exhaust valve 60 is actuated by a cam 62 on the crankshaft 14, with the cam cyclically driving a tappet 64 that in turn reciprocates a pushrod 66. The pushrod 66 operates a rocker arm 68 on the cylinder head 18, to reciprocate the exhaust valve 60 periodically as required during engine operation. Other mechanisms may be used alternatively to operate the exhaust valve, e.g., an overhead cam driven by a rotary shaft from the crankshaft, etc. Also, other conventional means (mechanical, electronic, pneumatic, etc.) may be used to adjust the valve timing as desired, depending upon engine speed and power output.

Figure 4A:
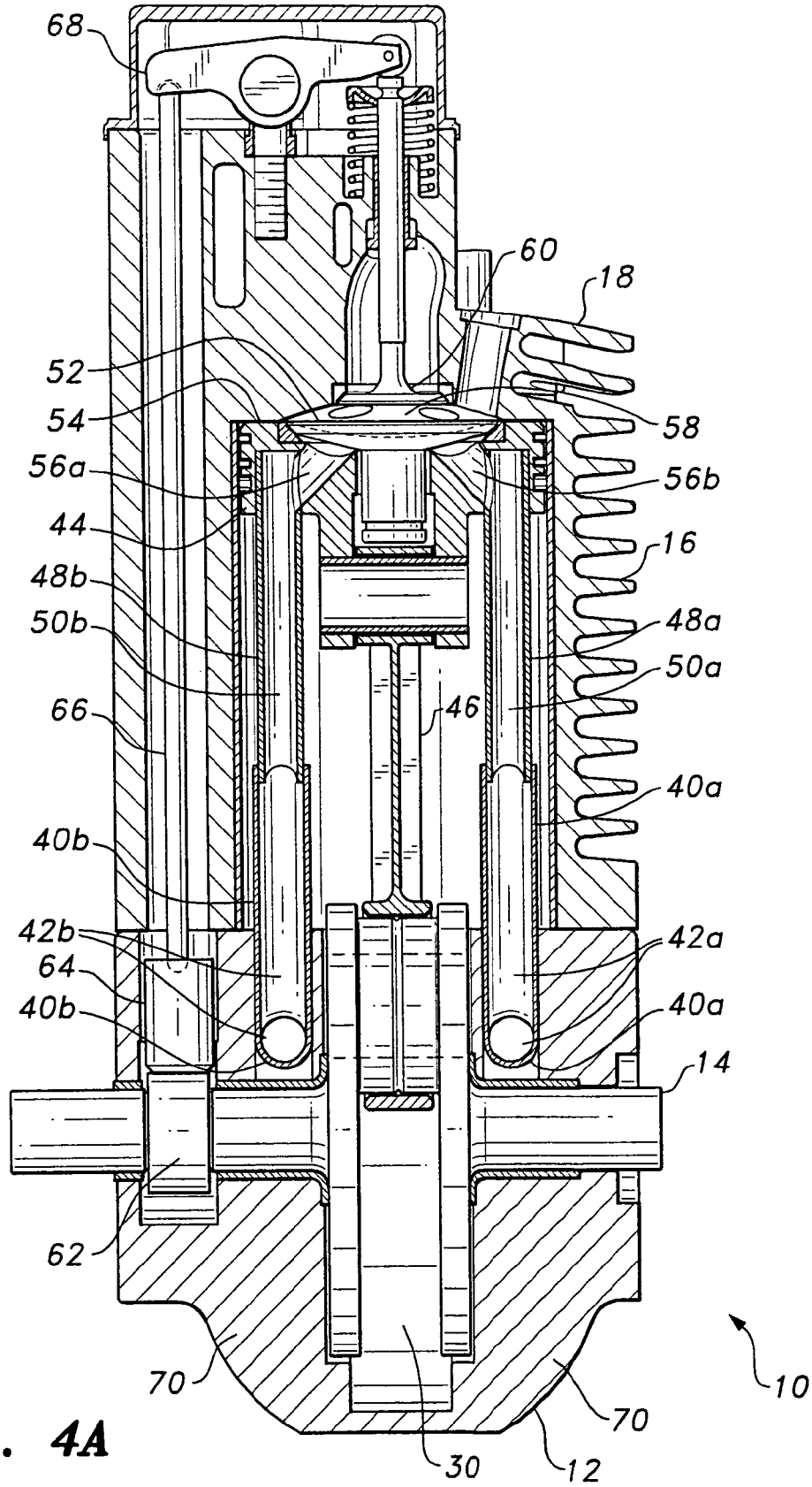
FIG. 4A is a section view along lines 4A-4A of FIG. 2, the engine being shown with the piston at top dead center.
Figure 4B:
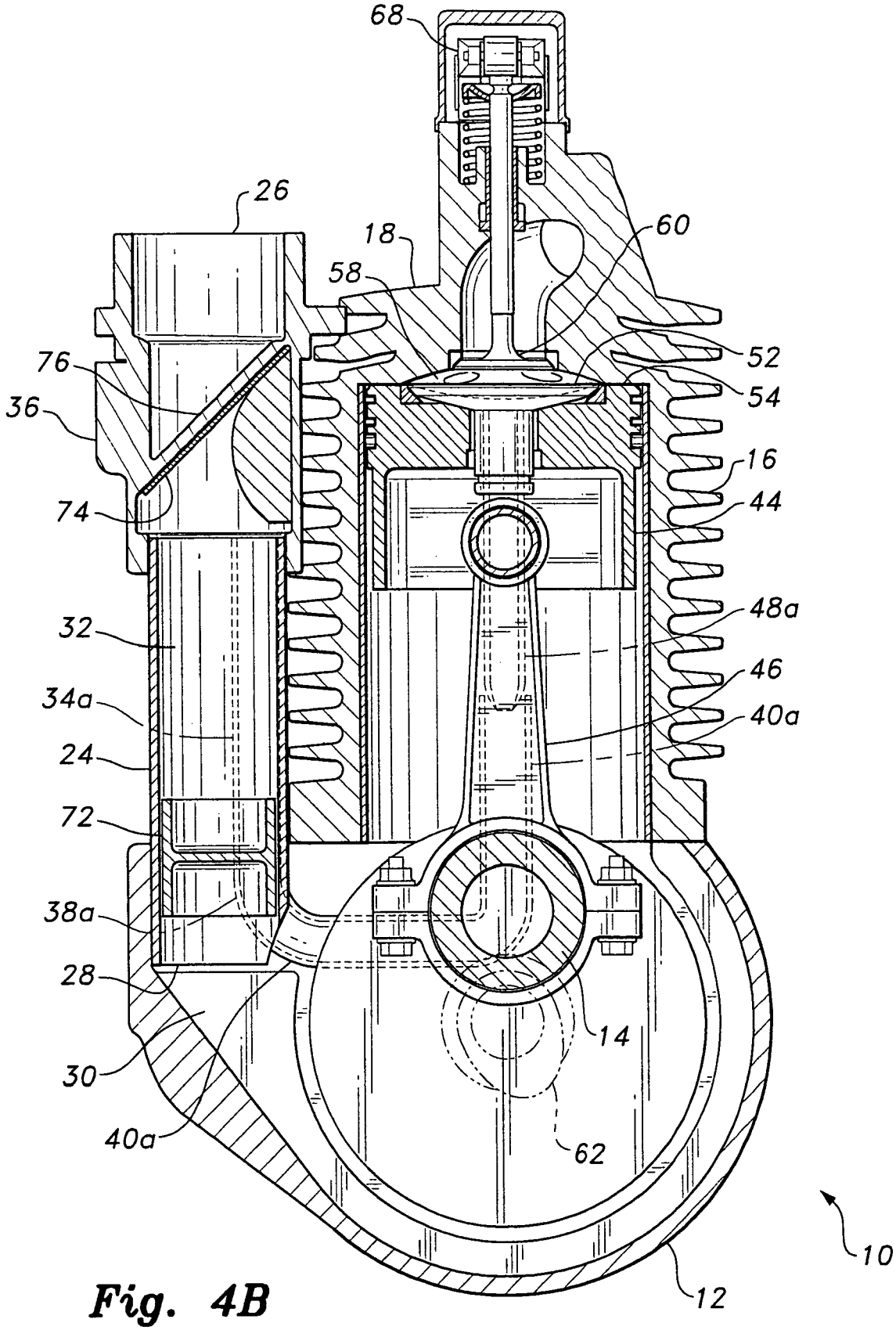
FIG. 4B is a section view along lines 4B-4B of FIG. 2.

The cycle begins as shown in FIGS. 4A and 4B, with the piston 44 at top dead center, i.e., the crank throw of the crankshaft 14 at its maximum height. At this point both the intake valve 52 and exhaust valve 60 are closed, in order to maximize pressure in the combustion chamber 58 for efficient operation. The rise of the piston 44 in the cylinder 16 has maximized the internal volumes 42*a*, 42*b*, 50*a*, and 50*b* within the inlet passages 40*a*, 40*b* and 48*a*, 48*b* as the piston 44 has lifted the piston inlet passages 48*a*, 48*b* upwardly.

Figure 5A:
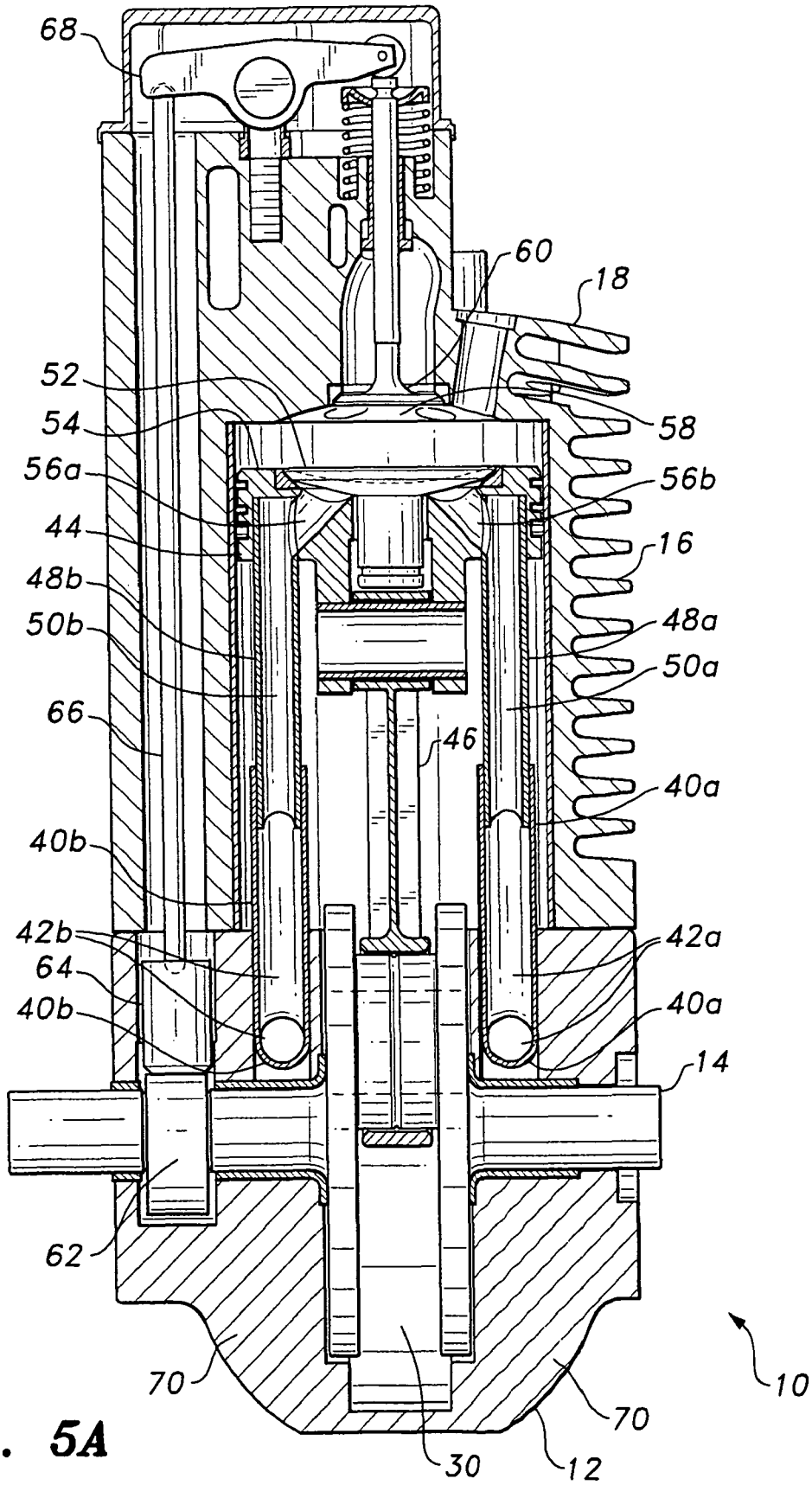
FIG. 5A is a right side elevation view in section of the engine of FIG. 1, the view being similar to FIG. 4A but shown with the crankshaft rotated 45° from the position shown in FIGS. 4A and 4B.
Figure 6A:
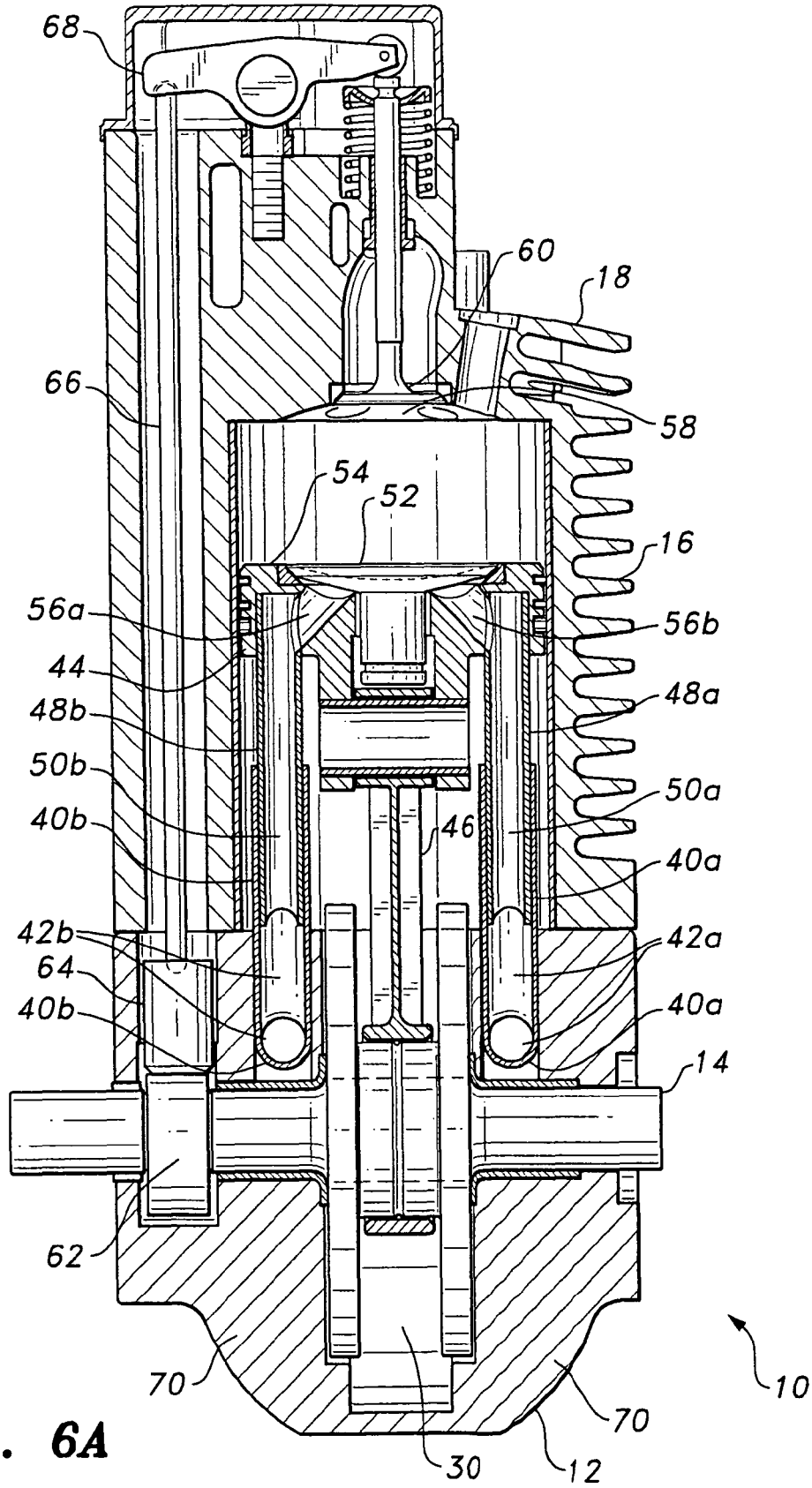
FIG. 6A is a right side elevation view in section of the engine of FIG. 1, the view being similar to FIG. 4A but shown with the crankshaft rotated 90° from the position shown in FIGS. 4A and 4B.

This also maximizes the fluid volume 30 within the crankcase 12, which draws air downwardly from the internal volume 32 of the intake column 24. In order to minimize this cyclic movement of air within the intake column 24, the internal fluid volume 30 of the crankcase 12 is minimized by filling the crankcase 12 insofar as possible with a solid, volume limiting filler 70 as shown in FIGS. 4A, 5A, 6A, etc. This filler 70 need not be of the same material as the metal crankcase 12 of the engine 10, but may be a lighter plastic material as desired, so long as it limits the internal fluid volume 30 of the crankcase 12 in order to minimize the transfer of air from the intake column 24 back and forth with the internal volume 30 of the crankcase 12. Sufficient room is left only for the eccentric rotation of the lower end of the connecting rod 46 on its crank throw, and for the lower portions of the internal crankcase intake passages 40*a* and 40*b*.

It will be seen that as the air within the volume 32 of the intake column 24 pulses back and forth during each cycle of engine operation, that air from the crankcase volume 30 is pushed upwardly into the intake column 24 during the downstroke of the piston 44 before being drawn back into the crankcase volume during the piston upstroke. The actual mixing of the crankcase air or gas with the intake air charge is minimal due to the rapidity of the cyclic operation of the engine 10. However, such mixing may be further minimized by the installation of a sliding, floating plunger or separator 72 within the intake column 24 to separate the air volume 30 of the crankcase 12 and the intake air charge portion within the intake column 24. The floating separator 72 slides upwardly and downwardly within the intake column 24 with each cycle of the engine 10 during operation, separating the air within the upper portion of the intake column 24 (which communicates with the incoming air within the external intake passages 34*a* and 34*b*, via the intake plenum 36) and the air volume 30 within the crankcase. In FIG. 4B, the piston 44 is at its maximum height, thereby drawing the floating separator 72 downwardly to its lowest point within the intake column 24. The pressure within the upper volume 32 of the intake column 24 has momentarily stabilized at this point, before beginning to increase as the piston 44 begins its descent and pushes the air within the crankcase 12 back into the lower portion of the intake column 24. Accordingly, the inlet valve 74 (e.g., carbon fiber flexible reed-type valve, etc.) within the intake plenum 36 is closed. A relatively thin brace 76, shown in section in FIGS. 4B through 11B, extends across the throat of the plenum 36 to limit excessive movement of the inlet valve 74 during closure. This brace 76 is shown essentially in its entirety in the top plan view of FIG. 2.

Figure 5B:
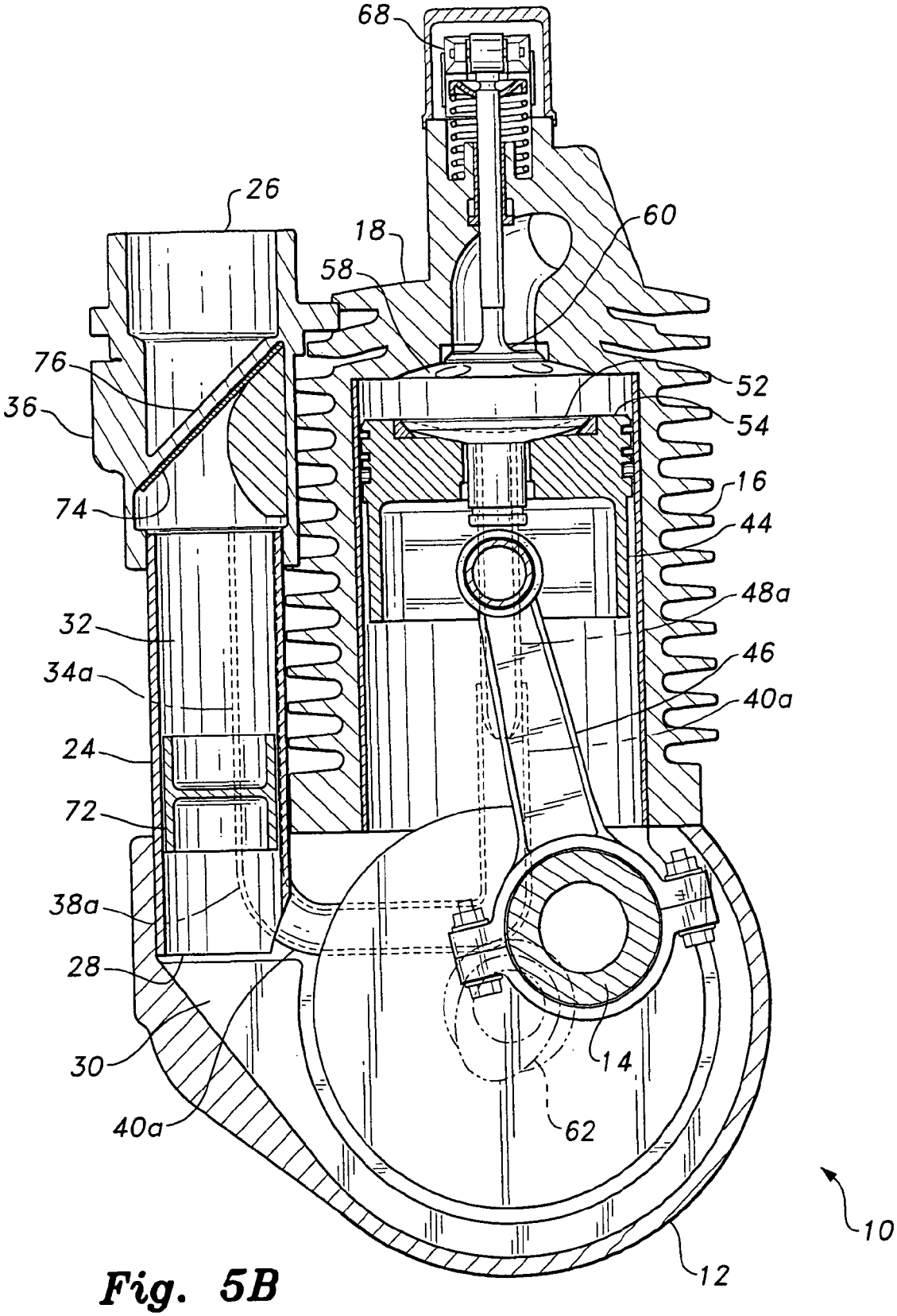
FIG. 5B is a rear elevation view in section of the engine of FIG. 1, the view being similar to FIG. 4B but shown with the crankshaft rotated 45° from the position shown in FIGS. 4A and 4B.

FIGS. 5A and 5B show the engine operation at a point of 45 degrees of clockwise rotation of the crankshaft 14 from that shown in FIGS. 4A and 4B, with the piston 44 having started its downward travel due to combustion pressure in the top of the cylinder 16. The exhaust valve 60 is closed at this point due to the orientation of the cam 62, and the intake valve 52 in the piston crown 54 is also closed due to the relatively high pressure within the combustion chamber 58 and upper portion of the cylinder 16 in comparison to that in the crankcase volume 30 and lower portion of the intake column 24. However, it will be seen that the descending piston 44 is reducing the internal volume 30 within lower portion of the cylinder 16 and the crankcase 12, and thus forcing contained crankcase air back into the lower portion of the intake column 24. This causes the floating separator 72 in the intake column 24 to begin to rise, with the increasing pressure within the upper portion of the intake column 24 and also within the telescoping crankcase tubes or passages 40*a*, 40*b* and piston tubes or passages 48*a*, 48*b* holding the reed valve 74 within the intake plenum 36 closed against ambient external pressure.

Figure 6B:
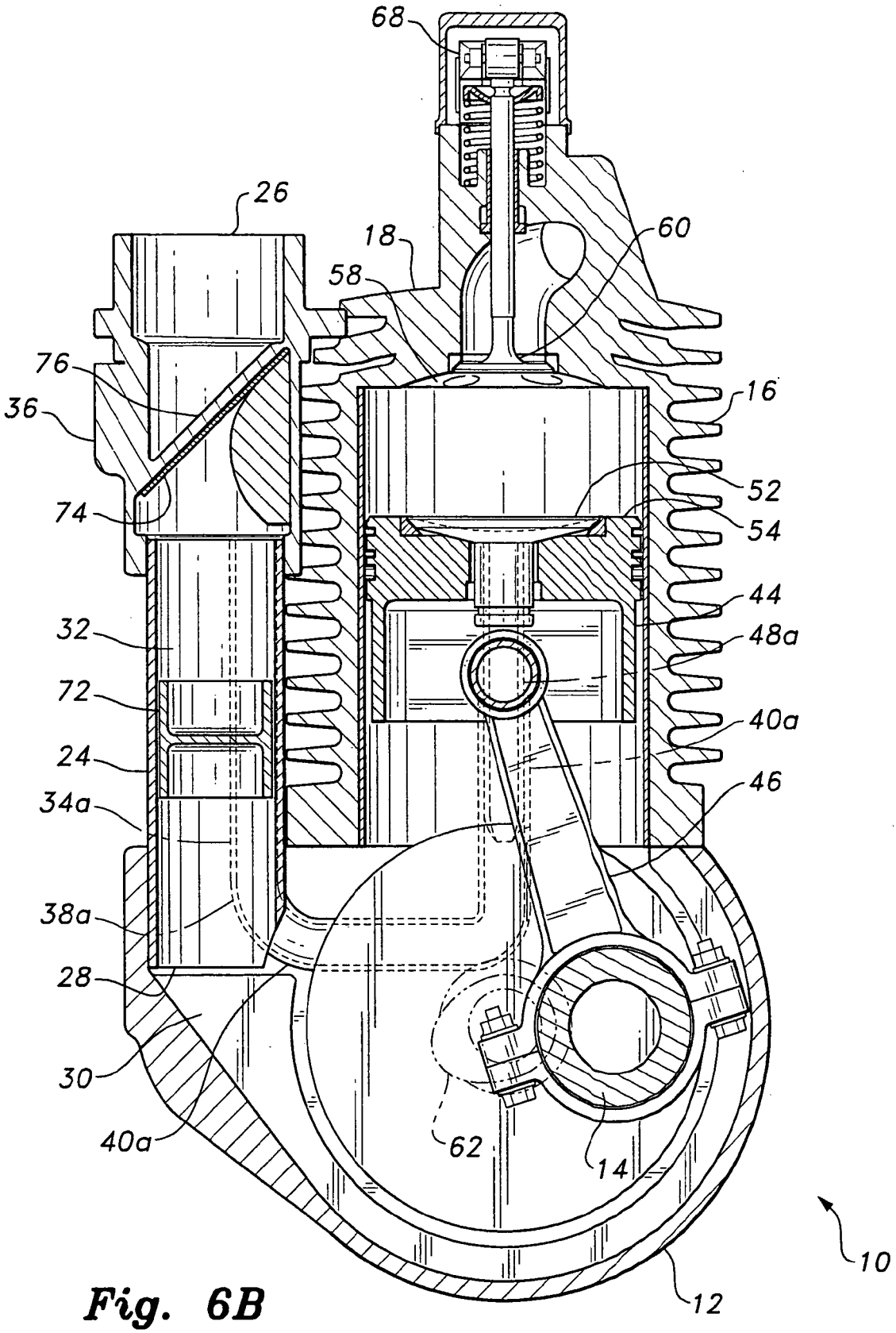
FIG. 6B is a rear elevation view in section of the engine of FIG. 1, the view being similar to FIG. 4B but shown with the crankshaft rotated 90° from the position shown in FIGS. 4A and 4B.

In FIGS. 6A and 6B, the crankshaft 14 is shown rotated 90 degrees from its initial top dead center position shown in FIGS. 4A and 4B. Combustion pressure continues to force the piston 44 downwardly in the cylinder 16, with the exhaust valve 60 and intake valve 52 remaining closed. The continuing reduction of the volume 30 within the crankcase 12 as the piston 44 descends forces the floating separator 72 further toward the inlet end 26 of the inlet column 24. The reduction of volume within the collapsing, telescoping crankcase tubes or passages 40*a*, 40*b* and piston tubes or passages 48*a*, 48*b* also increases the pressure within the upper portion of the inlet column 24 to hold the reed intake valve 74 closed, but the volume in the crankcase 30 and below the floating separator 72 is at least slightly greater than the volume in the tubes or passages 40*a*, 40*b*, 48*a*, and 48*b*, thus causing the floating separator 72 to rise somewhat within the inlet column 24.

Figure 7A:
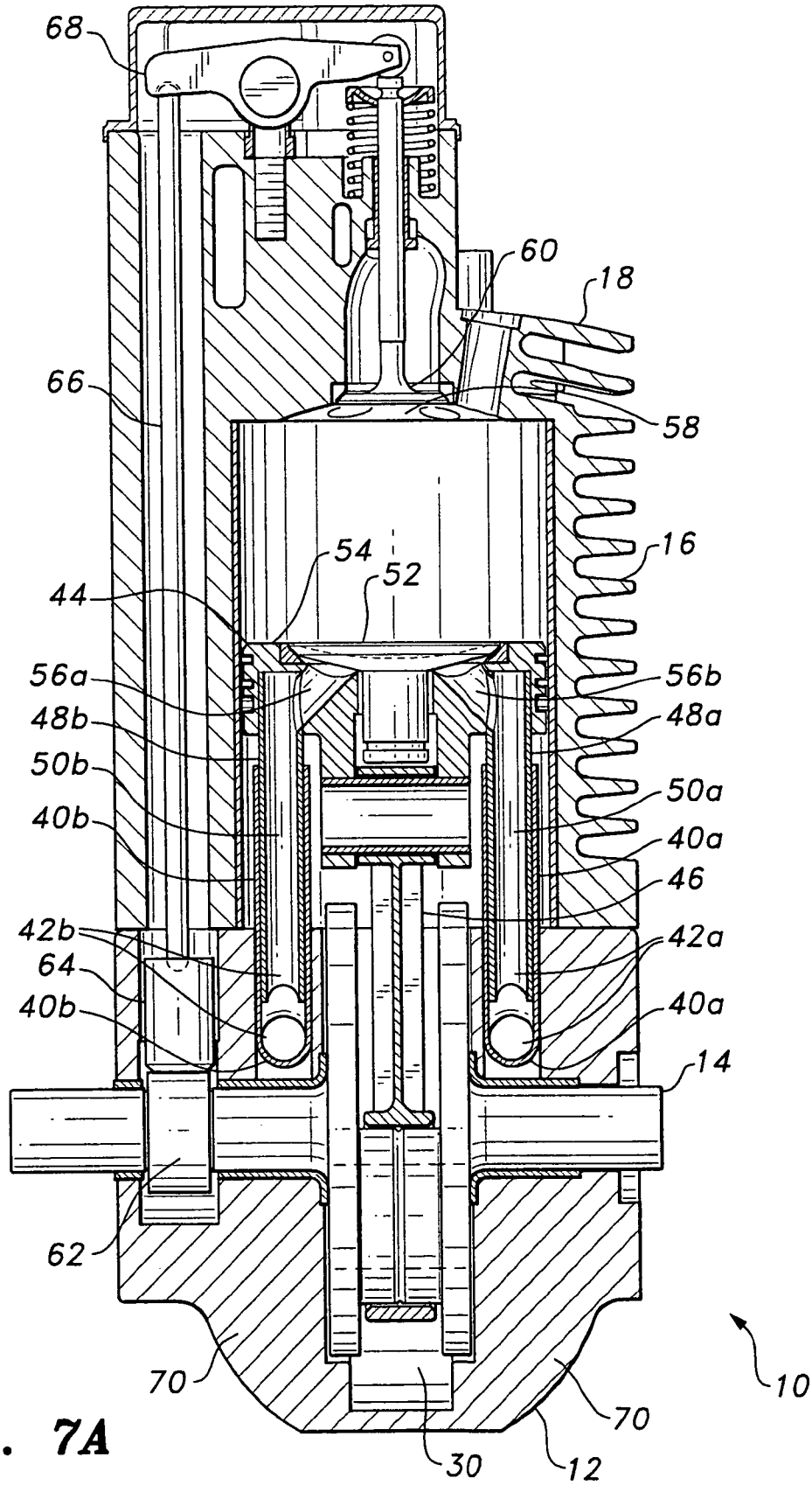
FIG. 7A is a right side elevation view in section of the engine of FIG. 1, the view being similar to FIG. 4A but shown with the crankshaft rotated 135° from the position shown in FIGS. 4A and 4B.
Figure 7B:
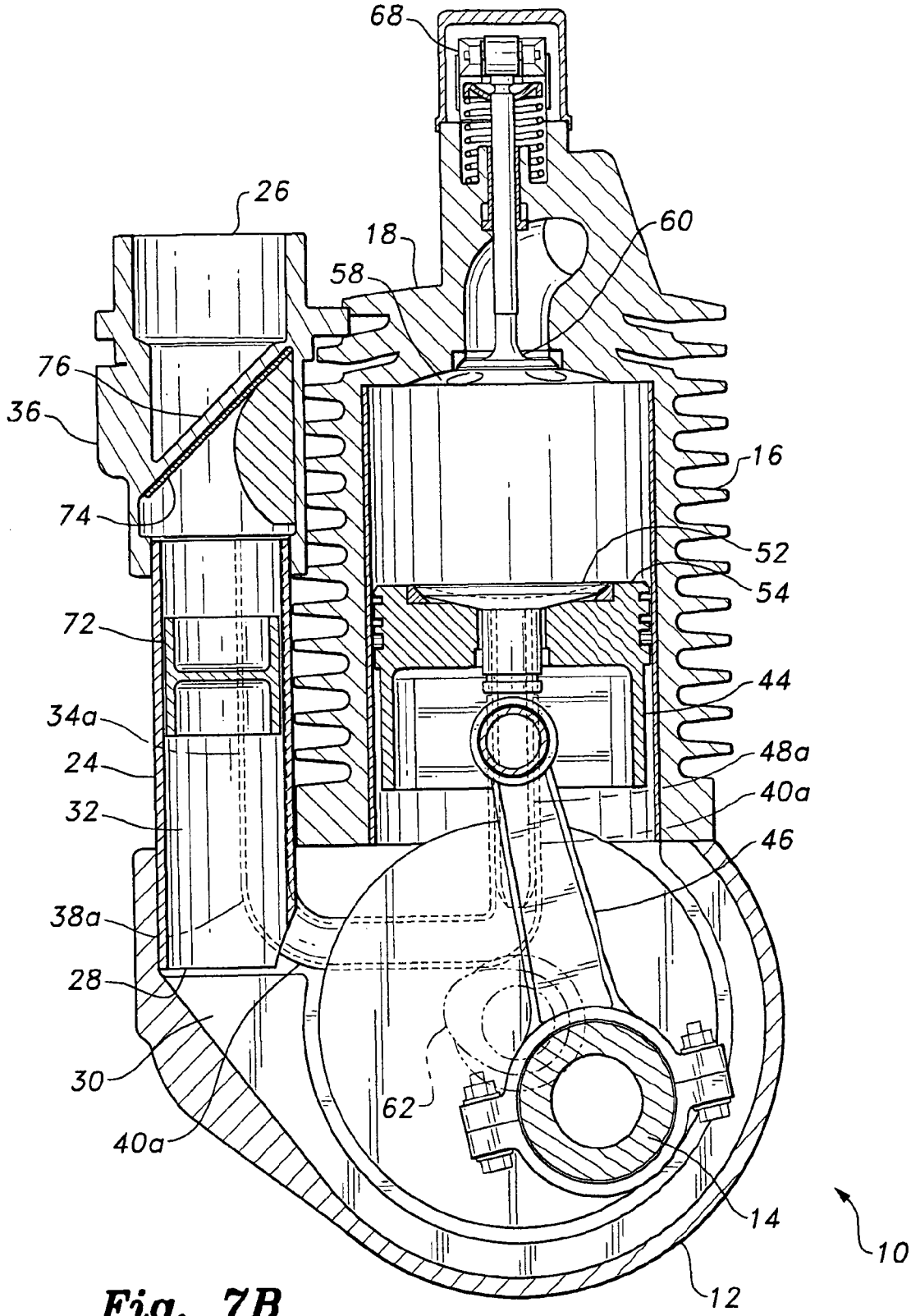
FIG. 7B is a rear elevation view in section of the engine of FIG. 1, the view being similar to FIG. 4B but shown with the crankshaft rotated 135° from the position shown in FIGS. 4A and 4B.

FIGS. 7A and 7B illustrate the engine 10 cycle with the crankshaft 14 rotated clockwise to about 135 degrees from the top dead center position shown in FIGS. 4A and 4B. The exhaust valve 60 remains closed, as the lobe of the cam 62 has not yet rotated around to begin to lift the tappet 64. The intake valve 52 also remains closed, as even though pressure within the cylinder 16 is dropping due to the expanding volume within the cylinder as the piston 44 continues its downstroke, the pressure within the cylinder still remains above that contained within the crankcase 12 and ambient atmosphere. As the piston 44 continues its downstroke and reduces the volume 30 within the crankcase 12, the pressure within the crankcase 12 pushes the floating separator 72 higher in the inlet column 24. This results in the reed intake valve 74 remaining closed.

Figure 8A:
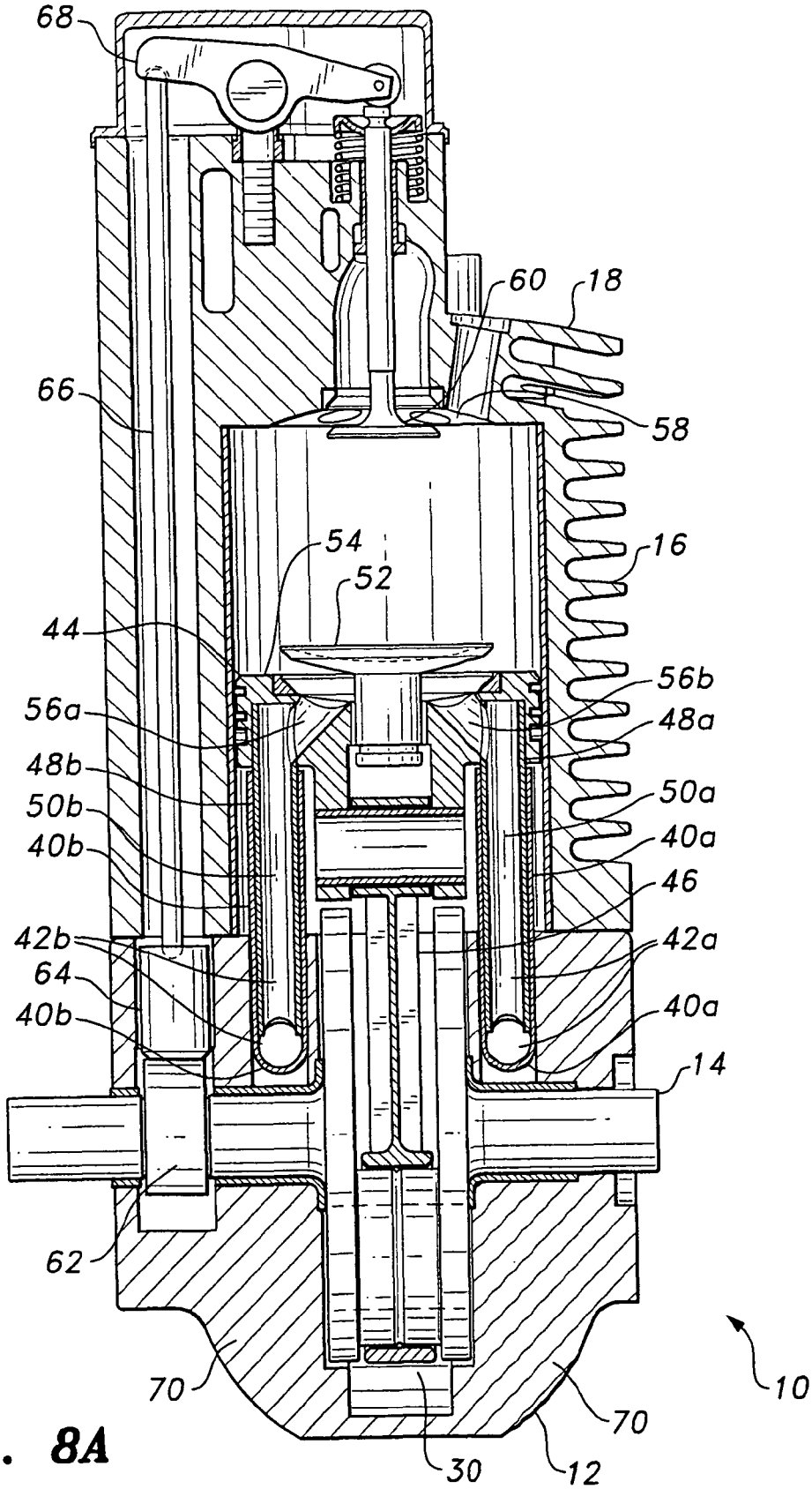
FIG. 8A is a right side elevation view in section of the engine of FIG. 1, the view being similar to FIG. 4A but shown with the crankshaft rotated 180° from the position shown in FIGS. 4A and 4B, i.e., with the piston at bottom dead center.
Figure 8B:
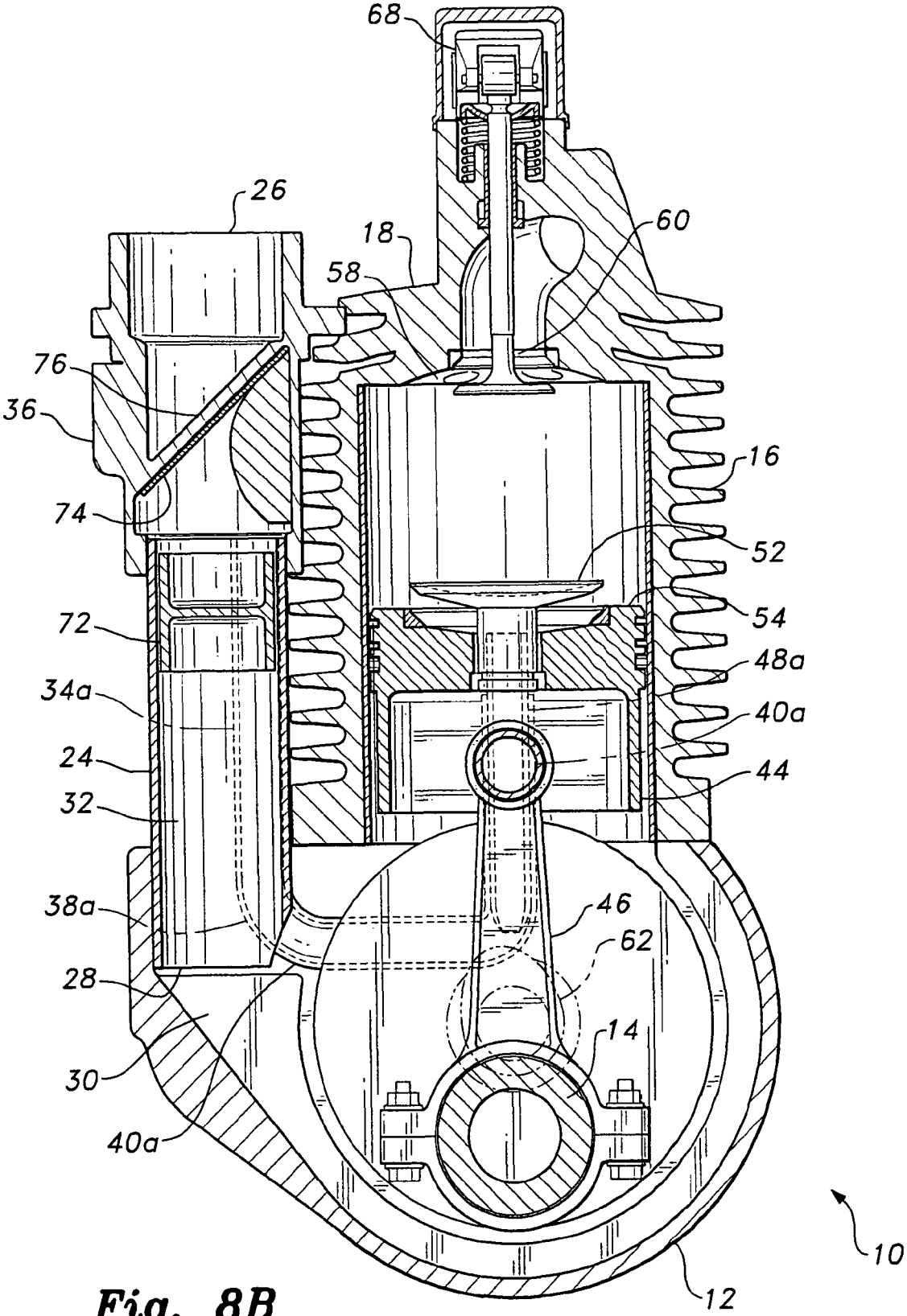
FIG. 8B is a rear elevation view in section of the engine of FIG. 1, the view being similar to FIG. 4B but shown with the crankshaft rotated 180° from the position shown in FIGS. 4A and 4B, i.e., with the piston at bottom dead center.

FIGS. 8A and 8B illustrate the positions of the internal components of the engine 10 when the piston 44 reaches bottom dead center, i.e., the crankshaft 14 has rotated 180 degrees from the top dead center position shown in FIGS. 4A and 4B. It will be seen that the lobe of the cam 62 has rotated to a point where it begins to lift the tappet 64, thus actuating the exhaust valve train to open the exhaust valve 60 and relieve the residual pressure within the cylinder 16. At this point the internal volume 30 within the crankcase 12 is minimized, thus producing the maximum pressure within the crankcase 12. This forces the floating separator 72 to its maximum height within the inlet column 24, thus minimizing the volume in the upper end of the column 24 below the reed intake valve 74. This lowest point of travel of the piston 44 also results in minimal volume within the collapsed telescoping inlet passages 40*a*, 40*b*, 48*a*, and 48*b*, which along with their communication with the upper portion of the internal volume of the inlet column 24, further increases the pressure within these passages to a pressure higher than that within the cylinder 16, particularly since the exhaust valve 60 is now open. This pressure differential between the nearly ambient pressure within the cylinder 16 due to the open exhaust valve 60 and the pressure buildup within the inlet passages 40*a*, 40*b*, 48*a*, and 48*b*, pushes the intake valve 52 in the piston crown 54 open, allowing a charge of fresh intake air to flow into the cylinder 16. The ports 56*a* and 56*b* that extend through the piston 44 preferably do not lie in a diametric vertical plane through the piston, but rather preferably extend upwardly and inwardly at some angle away from the center of the piston 44. This results in the incoming charge swirling or spiraling about the interior of the cylinder 16 as the charge is confined by the interior cylinder wall. This swirling or spiraling action of the incoming charge may be either clockwise or counterclockwise, depending upon the orientation of the ports 56*a*, 56*b* through the piston 44. As the exhaust valve 60 is open as the intake air charge enters the cylinder 16, the intake air charge assists in expelling the exhaust from the cylinder 16 to reduce the adulteration of the confined charge within the cylinder 16 for the next combustion event in the cycle.

Figure 9A:
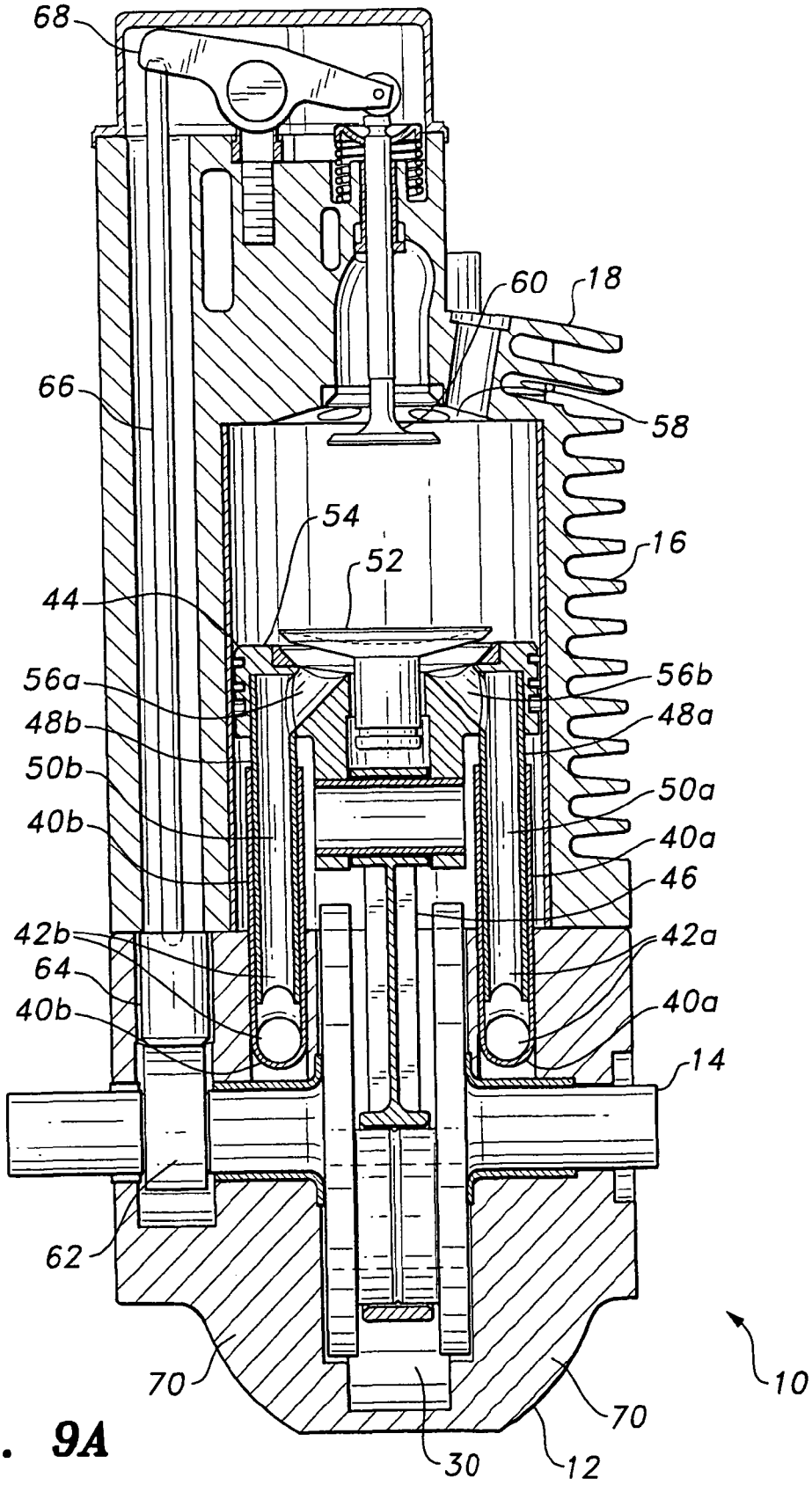
FIG. 9A is a right side elevation view in section of the engine of FIG. 1, the view being similar to FIG. 4A but shown with the crankshaft rotated 225° from the position shown in FIGS. 4A and 4B.
Figure 9B:
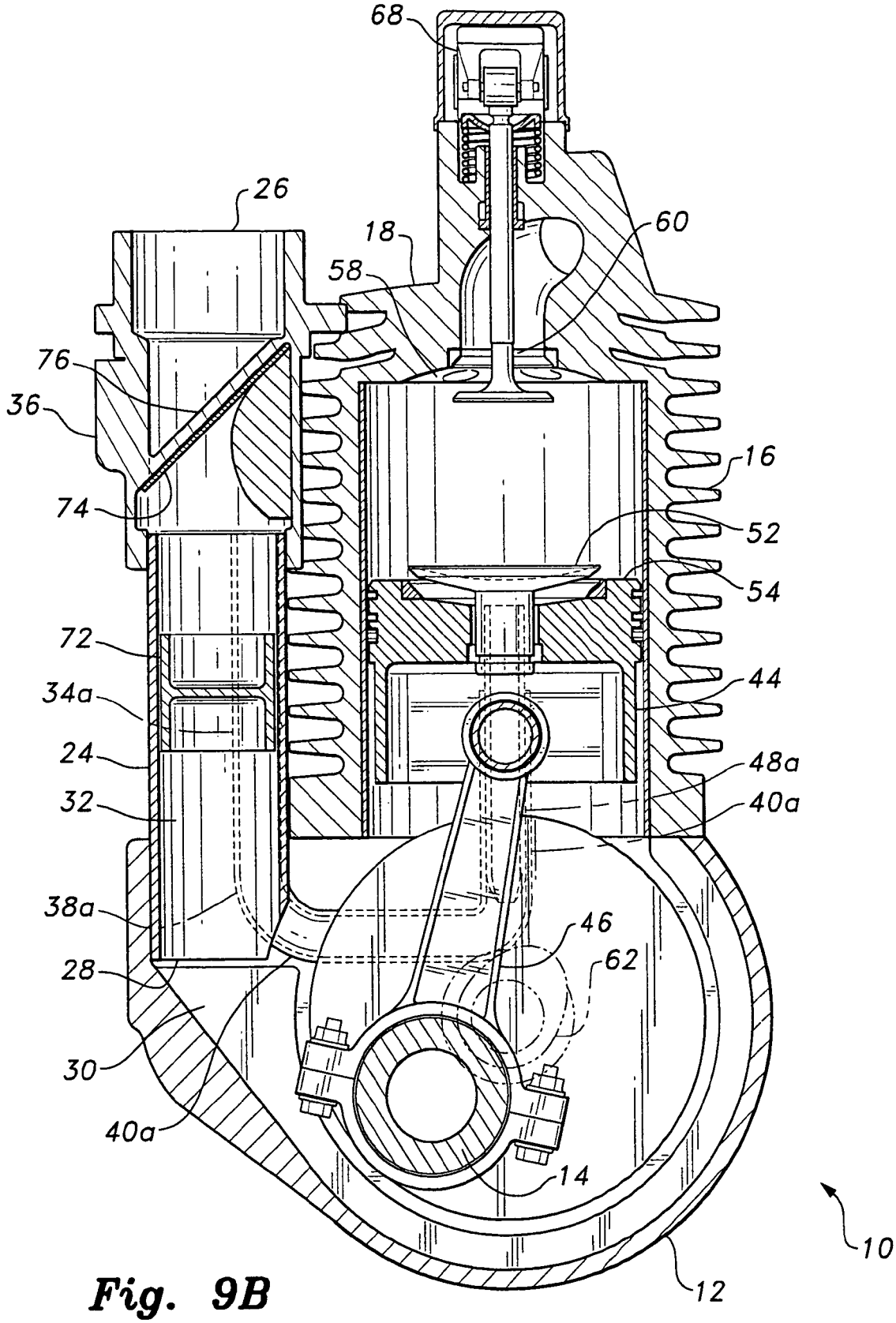
FIG. 9B is a rear elevation view in section of the engine of FIG. 1, the view being similar to FIG. 4B but shown with the crankshaft rotated 225° from the position shown in FIGS. 4A and 4B.

In FIGS. 9A and 9B, the crankshaft 14 is shown rotated about 225 degrees from its initial top dead center position of FIGS. 4A and 4B, with the piston 44 starting its upward travel in the cylinder 16. The lobe of the cam 62 has not rotated sufficiently to allow the tappet or lifter 64 to drop, with the exhaust valve 60 thus remaining at least somewhat open. The relatively small volumes 42*a*, 42*b*, 50*a*, and 50*b* within the crankcase inlet passages 40*a*, 40*b* and piston inlet passages 48*a*, 48*b* still result in relatively high pressure within these passages, thus forcing more intake air into the cylinder 16 through the open intake valve 52 in the piston crown 54. However, pressure within the inlet tubes or passages 40*a*, 40*b*, 48*a*, and 48*b* still remains relatively high due to their reduced volume and the reduced volume in the upper portion of the intake column 24 due to the relatively high pressure in the crankcase 12 forcing the floating separator 72 upwardly in the intake column 24, thus continuing to hold the intake reed valve 74 closed.

Figure 10A:
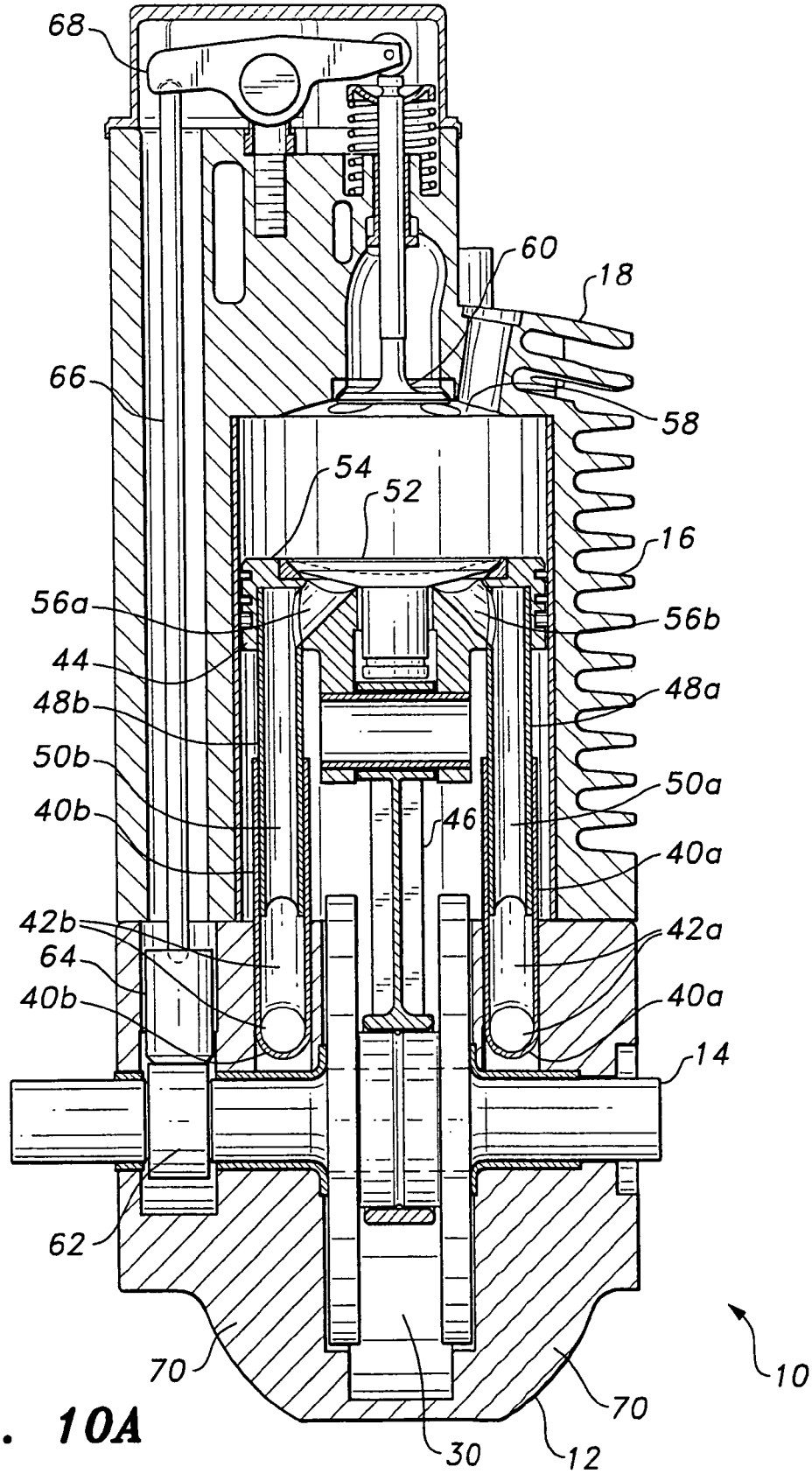
FIG. 10A is a right side elevation view in section of the engine of FIG. 1, the view being similar to FIG. 4A but shown with the crankshaft rotated 270° from the position shown in FIGS. 4A and 4B.
Figure 10B:
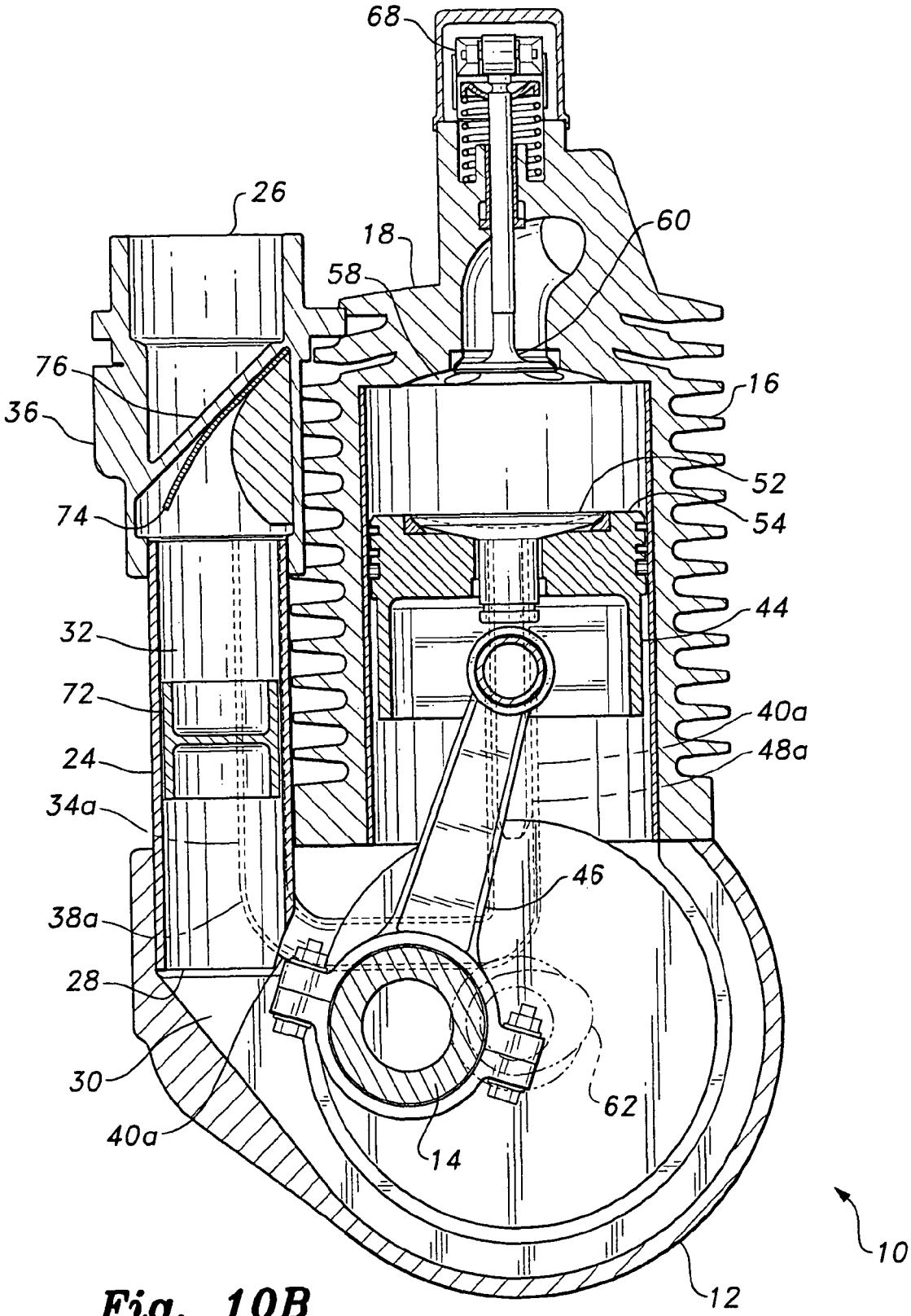
FIG. 10B is a rear elevation view in section of the engine of FIG. 1, the view being similar to FIG. 4B but shown with the crankshaft rotated 270° from the position shown in FIGS. 4A and 4B.

FIGS. 10*a* and 10*b* show the engine 10 at the point of its cycle where the crankshaft 14 has rotated about 270 degrees, or three quarters of the way clockwise from its initial top dead center position shown in FIGS. 4A and 4B. At this point in the cycle, the lobe of the cam 62 has rotated beyond the tappet or lifter 64, thus allowing the exhaust valve 60 to close. The closure of the exhaust valve 60, along with the upward travel of the piston 44 in the cylinder 16, results in the closing of the intake valve 52 in the piston crown 54. This initiates the compression of the fresh air charge in the now closed cylinder, for the next combustion event and power stroke. The piston inlet tubes or passages 48*a*, 48*b* are extending from their respective fixed crankcase inlet tubes or passages 40*a* and 40*b*, thus increasing the volumes 42*a*, 42*b* and 50*a*, 50*b* therein. This causes a reduction in pressure within the upper portion of the intake column 24, The internal pressure within the column 24 is reduced further due to the floating separator 72 being drawn downwardly in the column 24 because of the now increasing volume and corresponding drop in pressure within the crankcase 12 due to the rising piston 44. The result is that the pressure within the upper portion of the inlet column 24 is reduced to a level lower than ambient with ambient air pressure thus forcing the inlet reed valve 74 open, generally as shown in FIG. 10*b*.

Figure 11A:
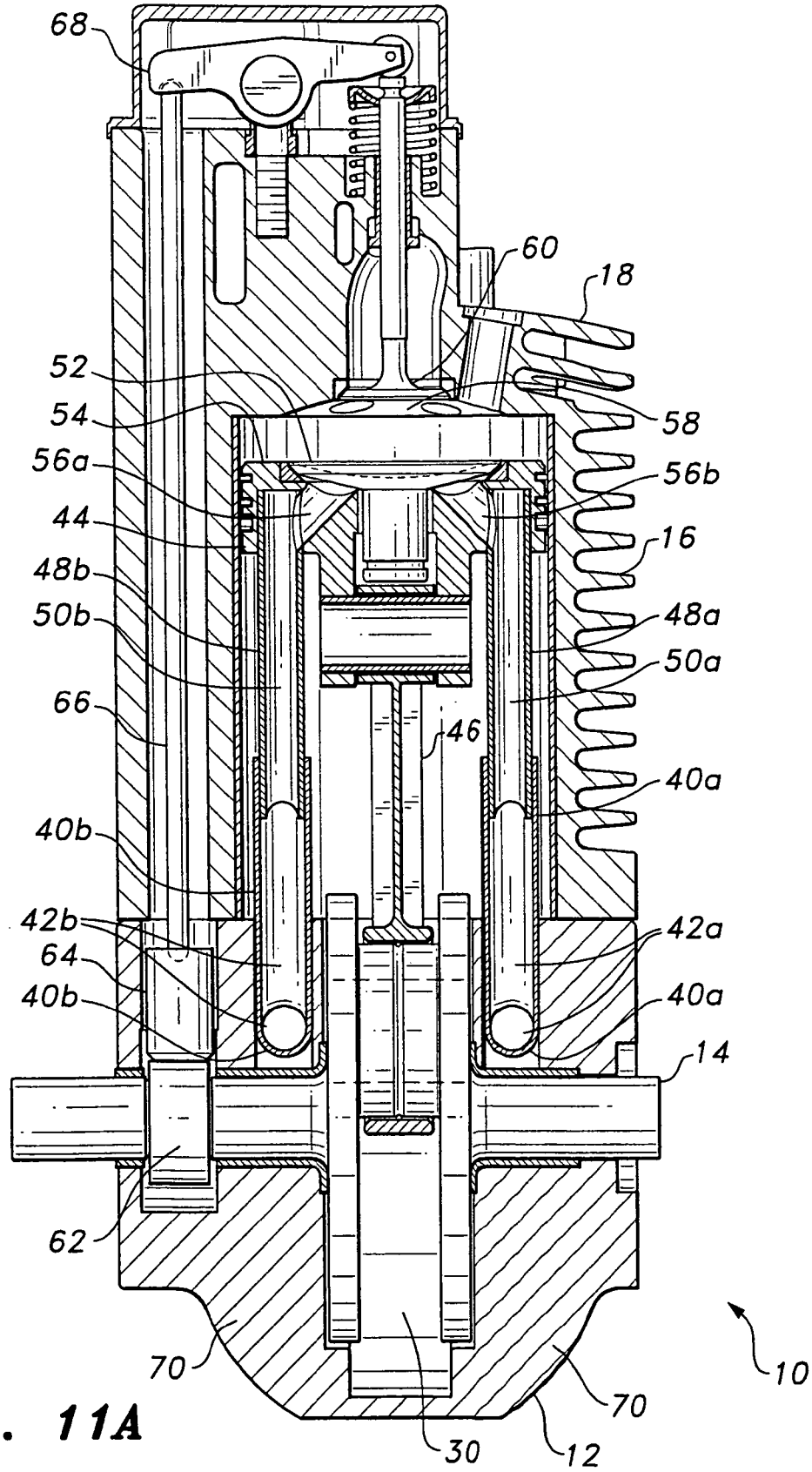
FIG. 11A is a right side elevation view in section of the engine of FIG. 1, the view being similar to FIG. 4A but shown with the crankshaft rotated 315° from the position shown in FIGS. 4A and 4B.
Figure 11B:
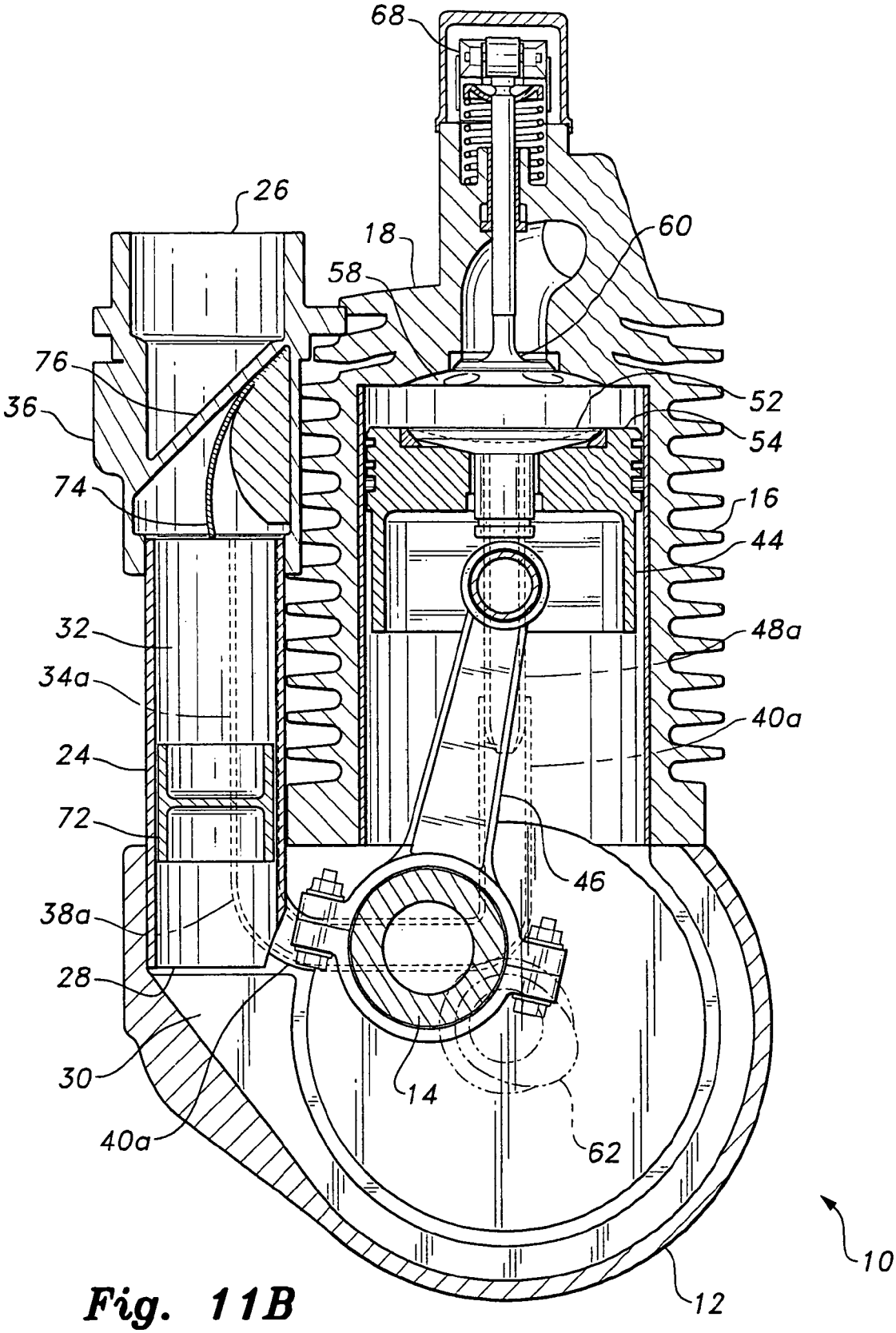
FIG. 11B is a rear elevation view in section of the engine of FIG. 1, the view being similar to FIG. 4B but shown with the crankshaft rotated 315° from the position shown in FIGS. 4A and 4B.

Finally, FIGS. 11A and 11B illustrate the positions of the internal components of the engine 10 when the crankshaft 14 has rotated to a point 315 degrees clockwise from its top dead center position of FIGS. 4A and 4B. At this point, both the exhaust valve 60 and intake valve 52 remain closed, thus further compressing the fresh intake charge in the top of the cylinder 16 for subsequent injection of fuel and ignition. The volume 30 within the crankcase 12 is increasing, thus drawing the floating separator 72 downwardly in its inlet column 24. This increases the volume in the upper portion of the intake column 24, and correspondingly reduces the pressure therein. Simultaneously, the telescoping piston inlet tubes 48*a*, 48*b* are being drawn further from the fixed crankcase inlet tubes 40*a*, 40*b*, thus expanding the volumes 42*a*, 42*b*, 50*a*, and 50*b* therein to reduce the pressure further within the tubes. The result of this relatively low pressure within the tubes or passages 40*a*, 40*b*, 48*a*, and 48*b* and the upper portion of the inlet column 24 is that the intake reed valve 74 is drawn further open, generally as shown in FIG. 11*b*. Shortly after this point, preferably at some point slightly before the piston 44 again reaches top dead center, fuel is injected through the injector 22 and ignition is initiated by the spark plug(s) 20 (FIG. 2), to begin the two-stroke cycle of operation anew.

Accordingly, it will be seen that the two-stroke engine 10, and other engine embodiments utilizing the same or similar separation of intake charge from the crankcase gases, provide an internal combustion power plant that essentially eliminates any contamination of the incoming air charge with oil vapor from the crankcase as occurs in conventional two-stroke engines. The engine 10 described above is depicted as an air-cooled, single cylinder engine. However, it will be seen that the operating principle described herein is adaptable to a number of other engine configurations.

Figure 12:
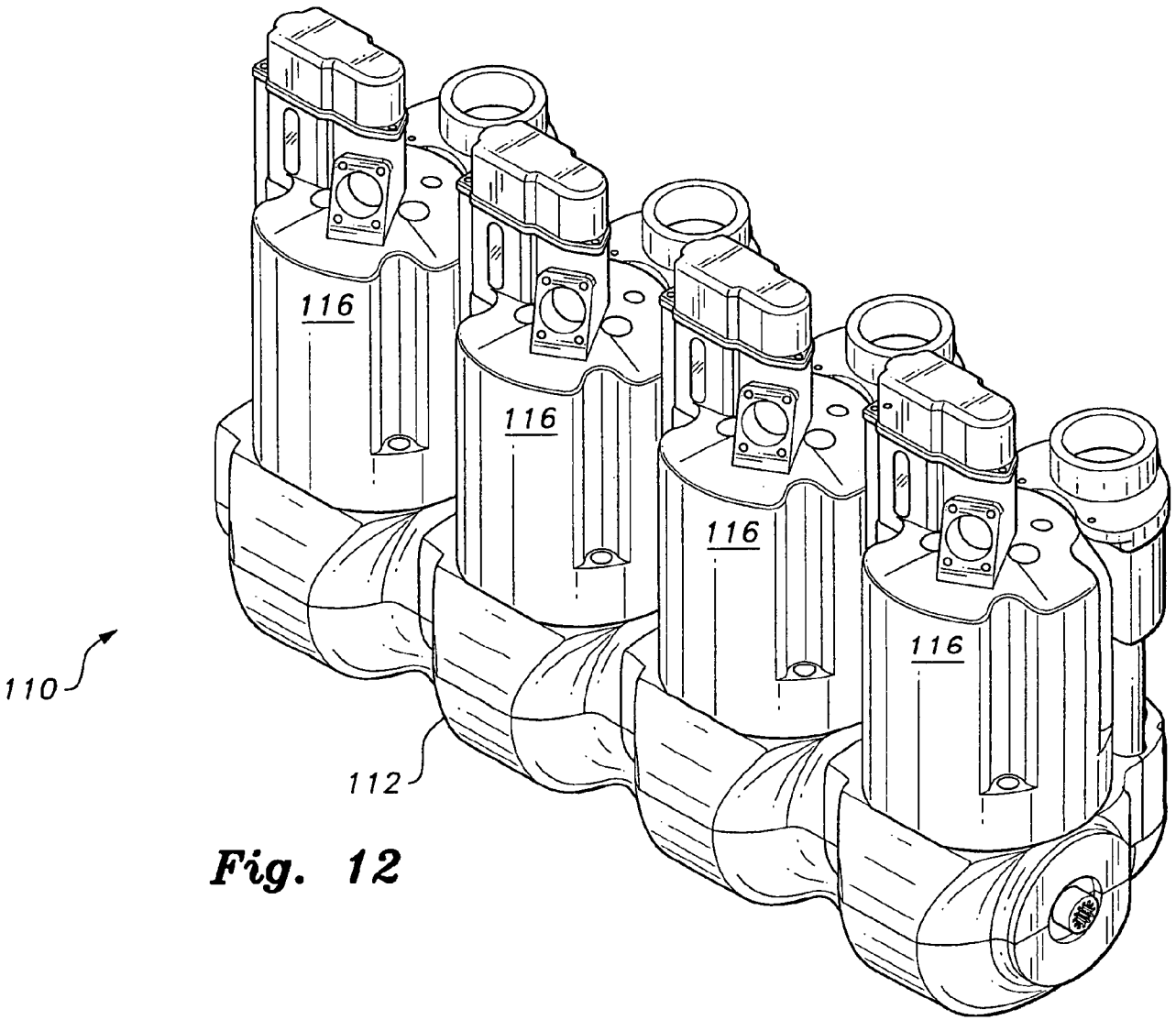
FIG. 12 is a right side perspective view of an alternative embodiment of a two-stroke engine according to the present invention having multiple liquid-cooled cylinders.

For example, FIG. 12 illustrates a multi-cylinder inline engine 110 having a single crankcase 112, with each of the cylinders 116 employing a water jacket therearound to provide liquid cooling. Air-cooled multiple cylinder engines are obviously possible using the present intake system, as well as single cylinder engines employing liquid cooling. While the engine 110 illustrated in FIG. 12 is shown as an inline four cylinder, it will be appreciated that other cylinder arrangements, e.g., Vee, horizontally opposed, radial, etc., may be constructed using the system described further above.

The system of separating the incoming air charge from the contaminated gases within the crankcase provides another advantage that has heretofore been difficult to attain in multiple cylinder two-stroke engines. Conventional multi-cylinder two-stroke engines require the separation from one another of the volumes within the crankcase that correspond with each cylinder. This is due to the initial compression of the incoming air charge in the crankcase as the piston descends on its power stroke. A single volume within the crankcase would not provide such initial compression, as the pistons are at various points in their cycles in a balanced engine and the charge within the crankcase would do no more than pulse or flow back and forth beneath the various pistons as they reciprocate at different times within their cylinders. The multi-cylinder two-stroke engine 110 precludes this problem by means of the novel inlet system that separates the incoming intake charge from the variable volume within the crankcase.

Moreover, while the engine 10 of FIGS. 1 through 11B is shown with multiple spark plugs, it will be understood that the engine may be constructed to operate using the two-stroke compression ignition (Diesel) principle, if so desired. Such an engine would require only a single glow plug for starting, rather than the multiple spark plugs illustrated with the engine 10 in FIG. 2 of the drawings. Accordingly, the two-stroke engine 10 and other embodiments thereof are adaptable to widespread application in a number of different fields and operating environments.

It is to be understood that the present invention is not limited to the embodiments described above, but encompasses any and all embodiments within the scope of the following claims.

I claim:

1. A two-stroke engine, comprising:

a crankcase defining a fluid volume therein;

a crankshaft disposed within the crankcase;

at least one cylinder extending from the crankcase;

a piston disposed within the cylinder, the piston being mechanically connected to the crankshaft;

at least one intake passage disposed within the crankcase, the intake passage having an intake volume therein; and at least one piston inlet passage depending from the piston, the piston inlet passage having an intake volume therein, the piston inlet passage telescoping with the intake passage, the intake passage and the piston inlet passage sealing the intake volumes therein from the volume of the crankcase.

2. The two-stroke engine according to claim 1, further including:

an intake column disposed externally to the cylinder and crankcase, the intake column having a base communicating with the crankcase, an inlet end opposite the base, and an intake column volume therein; and a freely floating separator disposed within the intake column, the separator separating the intake column volume into a first portion between the separator and the inlet end and a second portion between the separator and the crankcase, the separator precluding mixing of the first portion and the second portion of the intake column volume with one another.

3. The two-stroke engine according to claim 1, wherein the piston has a crown, the two-stroke engine further including:

a cylinder head disposed atop the cylinder;

a poppet intake valve disposed concentrically within the crown of the piston; and a poppet exhaust valve disposed concentrically within the cylinder head.

4. The two-stroke engine according to claim 1, further including a solid, fluid volume limiting filler disposed within a portion of the crankcase volume.

5. The two-stroke engine according to claim 1, further including:

an exhaust cam disposed upon the crankshaft;

a cylinder head disposed atop the cylinder;

a pushrod extending between the exhaust cam and the cylinder head;

a rocker arm disposed upon the cylinder head, the rocker arm communicating mechanically with the pushrod; and a poppet exhaust valve disposed concentrically within the cylinder head, the exhaust valve communicating mechanically with the rocker arm.

6. The two-stroke engine according to claim 1, wherein a plurality of cylinders extend from the crankcase.

7. The two-stroke engine according to claim 1, further including a coolant jacket disposed about the at least one cylinder.

8. A two-stroke engine, comprising:

a crankcase defining a fluid volume therein;

a crankshaft disposed within the crankcase;

at least one cylinder extending from the crankcase;

a piston disposed within the cylinder, the piston being mechanically connected to the crankshaft;

an intake column disposed externally to the cylinder and crankcase, the intake column having a base communicating with the crankcase, an inlet end opposite the base, and an intake column volume therein;

a freely floating separator disposed within the intake column, the separator separating the intake column volume into a first portion between the separator and the inlet end and a second portion between the separator and the crankcase, the separator precluding mixing of the first portion and the second portion of the intake column volume with one another;

at least one intake passage disposed within the crankcase, the intake passage having an intake volume therein; and at least one piston inlet passage depending from the piston, the piston inlet passage having an intake volume therein, the piston inlet passage telescoping with the intake passage, the intake passage and the piston inlet passage sealing the intake volumes therein from the volume of the crankcase.

9. The two-stroke engine according to claim 8, wherein the piston has a crown, the two-stroke engine further including:

a cylinder head disposed atop the cylinder;

a poppet intake valve disposed concentrically within the crown of the piston; and a poppet exhaust valve disposed concentrically within the cylinder head.

10. The two-stroke engine according to claim 8, further including a solid, fluid volume limiting filler disposed within a portion of the crankcase volume.

11. The two-stroke engine according to claim 8, further including:

an exhaust cam disposed upon the crankshaft;

a cylinder head disposed atop the cylinder;

a pushrod extending between the exhaust cam and the cylinder head;

a rocker arm disposed upon the cylinder head, communicating mechanically with the pushrod; and a poppet exhaust valve disposed concentrically within the cylinder head, communicating mechanically with the rocker arm.

12. The two-stroke engine according to claim 8, wherein a plurality of cylinders extend from the crankcase.

13. The two-stroke engine according to claim 8, farther including a coolant jacket disposed about the at least one cylinder.

14. A two-stroke engine, comprising:

a crankcase defining a fluid volume therein;

a crankshaft disposed within the crankcase;

at least one cylinder extending from the crankcase;

a cylinder head disposed atop the cylinder;

a piston disposed within the cylinder, the piston being mechanically connected to the crankshaft, the piston having a crown;

a poppet intake valve disposed concentrically within the crown of the piston;

a poppet exhaust valve disposed concentrically within the cylinder head;

at least one intake passage disposed within the crankcase, the intake passage having an intake volume therein; and at least one piston inlet passage depending from the piston, the piston inlet passage having an intake volume therein, the piston inlet passage telescoping with the intake passage, the intake passage and the piston inlet passage sealing the intake volumes therein from the volume of the crankcase.

15. The two-stroke engine according to claim 14, further including:

an intake column disposed externally to the cylinder and crankcase, the intake column having a base communicating with the crankcase, an inlet end opposite the base, and an intake column volume therein; and a freely floating separator disposed within the intake column, the separator separating the intake column volume into a first portion between the separator and the inlet end and a second portion between the separator and the crankcase, the separator precluding mixing of the first portion and the second portion of the intake column volume with one another.

16. The two-stroke engine according to claim 14, further including a solid, fluid volume limiting filler disposed within a portion of the crankcase volume.

17. The two-stroke engine according to claim 14, further including:

an exhaust cam disposed upon the crankshaft;

a cylinder head disposed atop the cylinder;

a pushrod extending between the exhaust cam and the cylinder head;

a rocker arm disposed upon the cylinder head, the rocker arm communicating mechanically with the pushrod; and a poppet exhaust valve disposed concentrically within the cylinder head, the exhaust valve communicating mechanically with the rocker arm.

18. The two-stroke engine according to claim 14, further including:

a single crankcase having a plurality of cylinders extending therefrom; and a coolant jacket disposed about the plurality of cylinders.

* * * * *